US011352775B2

(12) United States Patent
Morrow

(10) Patent No.: US 11,352,775 B2
(45) Date of Patent: Jun. 7, 2022

(54) LIGHT WEIGHT CONSTRUCTION SYSTEM BASED ON HORIZONTALLY PRE-SLOTTED PANELS

(71) Applicant: Blue Tomato LLC, Provo, UT (US)

(72) Inventor: Brian D. Morrow, Provo, UT (US)

(73) Assignee: BLUE TOMATO, LLC, Provo, UT (US)

( * ) Notice: Subject to any disclaimer, the term of this patent is extended or adjusted under 35 U.S.C. 154(b) by 0 days.

(21) Appl. No.: 16/824,209

(22) Filed: Mar. 19, 2020

(65) Prior Publication Data

US 2021/0040722 A1 Feb. 11, 2021

Related U.S. Application Data

(63) Continuation-in-part of application No. 16/709,674, filed on Dec. 10, 2019, now Pat. No. 10,865,560.

(Continued)

(51) Int. Cl.
*E04B 1/02* (2006.01)
*E04B 1/18* (2006.01)

(Continued)

(52) U.S. Cl.
CPC ..... *E04B 1/02* (2013.01); *E04B 1/18* (2013.01); *E04B 5/023* (2013.01); *E04B 7/026* (2013.01); *E04C 2/46* (2013.01); *E04C 2002/004* (2013.01)

(58) Field of Classification Search
None
See application file for complete search history.

(56) References Cited

U.S. PATENT DOCUMENTS 2,202,783 A * 5/1940 Morrell ..... E04B 2/58 52/475.1
2,321,567 A * 6/1943 Wilson ..... E04B 2/80 52/580

(Continued)

FOREIGN PATENT DOCUMENTS

DE 3034601 A1 4/1982
FR 2359942 7/1976

(Continued)

OTHER PUBLICATIONS

Non-Final Office Action received for U.S. Appl. No. 16/549,901, dated Sep. 4, 2020.

(Continued)

*Primary Examiner* — Joshua K Ihezie
(74) *Attorney, Agent, or Firm* — Workman Nydegger

(57) ABSTRACT

Modular building methods and systems using lightweight modular panels, and specially configured transition panels for transitioning from wall to floor, or from wall to roof. Identically configured standard panels are used for constructing the walls, floor, and roof, with transitions from one structure to the next (e.g., wall to floor, or wall to roof). Each of the variously configured panel types includes channels (e.g., 2 pair of channels) formed through the length of the foam body, where the channels are configured to receive splines (e.g., flanges of an I-beam) therein. In the standard panel, the channels may include pairs of top and bottom channels, with the channels offset towards the respective panel major faces. In the transition panels, the channels may be similarly configured, but positioned differently to make the appropriate transition. The splines are connected to a frame, which acts as a template and transfers loads to a foundation.

18 Claims, 28 Drawing Sheets

Related U.S. Application Data

(60) Provisional application No. 62/991,889, filed on Mar. 19, 2020, provisional application No. 62/777,648, filed on Dec. 10, 2018, provisional application No. 62/890,818, filed on Aug. 23, 2019.

(51) Int. Cl.

| | |
|---|---|
| ***E04B 5/02*** | (2006.01) |
| ***E04B 2/00*** | (2006.01) |
| ***E04B 7/02*** | (2006.01) |
| *E04C 2/00* | (2006.01) |

(56) References Cited

U.S. PATENT DOCUMENTS 2,844,848 A 7/1958 Couse et al.
3,236,014 A 2/1966 Edgar
3,284,980 A 11/1966 Dinkel
3,310,917 A * 3/1967 Simon ..... F16B 5/002 52/91.1
3,353,315 A * 11/1967 Barker ..... E04C 2/22 52/275
3,374,703 A * 3/1968 Davis ..... E04B 1/615 411/466
3,517,468 A 6/1970 Woods
3,529,390 A * 9/1970 Stetter ..... E04B 2/18 52/285.1
3,646,715 A 3/1972 Pope
3,699,731 A 10/1972 Arnold
3,775,916 A 12/1973 Bair
3,808,085 A 4/1974 Givens
3,888,055 A 6/1975 Gallo
4,035,972 A * 7/1977 Timmons ..... E04B 1/6145 52/241
4,435,928 A * 3/1984 Huling, III ..... E04B 1/49 52/309.4
4,443,988 A * 4/1984 Coutu, Sr. ..... E04B 1/80 52/309.2
4,578,909 A * 4/1986 Henley ..... E04B 1/74 52/210
4,578,915 A 4/1986 Schneller
4,615,448 A 10/1986 Johnstonbaugh
4,617,219 A 10/1986 Schupack
4,641,468 A * 2/1987 Slater ..... E04B 1/12 52/309.4
4,774,794 A * 10/1988 Grieb ..... E04B 7/225 52/309.12
4,893,451 A 1/1990 Valente
4,944,416 A 7/1990 Petersen
5,003,742 A * 4/1991 Dettbarn ..... E04B 2/707 52/282.3
5,030,502 A 7/1991 Teare
5,062,387 A 11/1991 Anderson
5,121,578 A 6/1992 Holz
5,138,803 A 8/1992 Grossen
5,172,532 A 12/1992 Gibbar
5,173,233 A 12/1992 Kafarowski
5,181,353 A * 1/1993 Harrington, Jr. ..... E04B 1/12 52/309.9
5,231,813 A * 8/1993 Drawdy ..... E04C 2/288 52/251
5,268,226 A 12/1993 Sweeney
5,353,560 A * 10/1994 Heydon ..... B26D 3/006 52/241
5,353,562 A * 10/1994 Decker ..... E04B 2/8629 256/31
5,377,470 A * 1/1995 Hebinck ..... E04B 1/14 52/309.12
5,390,462 A 2/1995 Kreiter
5,403,062 A 4/1995 Sjostedt et al.
D384,108 S 9/1997 Rinicella
5,694,730 A * 12/1997 Del Rincon ..... E04B 1/6154 403/298
5,803,964 A * 9/1998 Scarborough ..... E04B 1/161 106/724
5,822,940 A * 10/1998 Carlin ..... E04B 2/7453 52/479
5,899,037 A * 5/1999 Josey ..... E04B 2/58 52/267
5,901,522 A 5/1999 Slater
5,921,046 A * 7/1999 Hammond, Jr. ..... E04B 1/12 52/564
5,927,032 A * 7/1999 Record ..... E04C 2/292 52/309.11
5,950,389 A * 9/1999 Porter ..... E04B 1/6145 52/586.1
D444,577 S 7/2001 Neuhofer
6,305,135 B1 * 10/2001 Inaba ..... B32B 5/18 52/309.12
6,324,809 B1 * 12/2001 Nelson ..... E04F 15/02 52/309.14
6,460,302 B1 * 10/2002 Neuhaus, III ..... E04B 1/161 106/724
6,470,632 B1 10/2002 Smith
6,481,172 B1 * 11/2002 Porter ..... B32B 5/18 52/506.01
6,571,523 B2 * 6/2003 Chambers ..... E04B 1/14 52/270
D477,423 S 7/2003 Campbell
6,701,683 B2 3/2004 Messenger
6,772,890 B2 8/2004 Campbell
6,985,832 B2 * 1/2006 Saebi ..... E04B 1/167 702/189
7,028,440 B2 * 4/2006 Brisson ..... E04B 1/12 52/309.16
7,036,196 B2 5/2006 Salatin
7,093,726 B1 8/2006 Holztrager
7,165,374 B2 * 1/2007 Ohanesian ..... B28B 7/0073 52/309.12
7,712,265 B2 5/2010 Overmyer
7,779,600 B1 * 8/2010 Saebi ..... E04B 1/161 52/745.19
7,913,730 B2 3/2011 Schaffeld
8,151,539 B2 * 4/2012 Grinsted ..... E04C 2/205 52/745.1
8,220,648 B2 7/2012 Barkdoll
8,468,767 B1 * 6/2013 McBride ..... E04F 13/0891 52/586.2
8,627,625 B2 1/2014 Bouchard
8,695,299 B2 * 4/2014 Propst ..... E04C 2/2885 52/309.11
9,234,355 B2 1/2016 Sealock et al.
D861,194 S * 9/2019 Morrow ..... D25/138
10,450,736 B2 10/2019 Morrow
10,865,560 B1 12/2020 Morrow
2005/0284060 A1 * 12/2005 Ritchie ..... E04C 2/22 52/309.7
2006/0046068 A1 3/2006 Barancyk et al.
2006/0207479 A1 9/2006 Hughes
2007/0131308 A1 * 6/2007 Martin ..... B27M 1/08 144/344
2008/0282632 A1 11/2008 Sleeman
2009/0100780 A1 * 4/2009 Mathis ..... E04C 2/386 52/578
2009/0205277 A1 * 8/2009 Gibson ..... E04C 2/296 52/309.9
2010/0011699 A1 * 1/2010 Weimer ..... E04C 2/40 52/745.1
2010/0083590 A1 4/2010 Wochnik
2010/0095625 A1 * 4/2010 Boutaghou ..... B32B 3/30 52/506.01
2010/0136269 A1 6/2010 Andersen
2011/0067331 A1 * 3/2011 Grinsted ..... E04C 2/205 52/309.4
2011/0173911 A1 * 7/2011 Propst ..... B32B 5/26 52/309.13
2011/0214374 A1 9/2011 Propst
2012/0011793 A1 * 1/2012 Clark ..... E04C 3/29 52/309.4
2013/0008129 A1 1/2013 Hall

(56) References Cited

U.S. PATENT DOCUMENTS

| | | | | |
|---|---|---|---|---|
| 2013/0086850 | A1 | 4/2013 | Morrow | |
| 2013/0216760 | A1 | 8/2013 | Bol | |
| 2013/0227902 | A1* | 9/2013 | Van Sloun | B32B 3/06 52/309.4 |
| 2013/0266370 | A1 | 10/2013 | Gunther | |
| 2014/0250827 | A1* | 9/2014 | Gillman | E04C 2/38 52/745.21 |
| 2015/0135634 | A1* | 5/2015 | Hoie | B29C 44/3461 52/741.4 |
| 2016/0014995 | A1 | 1/2016 | Bruno | |
| 2016/0208489 | A1* | 7/2016 | Gibson | E04B 7/22 |
| 2017/0096825 | A1 | 4/2017 | Bree | |
| 2017/0121958 | A1 | 5/2017 | Jin | |
| 2017/0211268 | A1 | 7/2017 | Eichhorn et al. | |
| 2018/0298600 | A1* | 10/2018 | Moss | E04C 2/388 |
| 2019/0242109 | A1* | 8/2019 | Morrow | E04B 2/562 |
| 2020/0001583 | A1 | 1/2020 | Eichhorn et al. | |
| 2020/0354945 | A1 | 11/2020 | Morrow | |
| 2021/0040733 | A1 | 2/2021 | Morrow | |
| 2021/0040759 | A1 | 2/2021 | Morrow | |
| 2021/0301528 | A1 | 9/2021 | Dombowsky et al. | |

FOREIGN PATENT DOCUMENTS

| | | |
|---|---|---|
| GB | 2261234 | 5/1993 |
| JP | H07-102680 | 4/1995 |
| JP | H10-148095 | 6/1998 |
| JP | 2002-292612 | 10/2002 |
| KR | 10-1993-0010328 | 6/1993 |
| KR | 10-2009-0065909 | 6/2009 |
| WO | 2013-052427 | 4/2013 |
| WO | 2018/194528 A1 | 10/2018 |
| WO | 2021/118744 | 6/2021 |

OTHER PUBLICATIONS

U.S. Application filed on Aug. 23, 2019. by Morrow., U.S. Appl. No. 16/549,901.
U.S. Appl. No. 13/866,569, filed Apr. 19, 2013, Morrow.
U.S. Appl. No. 15/426,756, filed Feb. 7, 2017, Morrow.
U.S. Appl. No. 29/648,685, filed May 23, 2018, Morrow.
U.S. Appl. No. 29/658,417, filed Jul. 31, 2018, Morrow.
International Search Report for PCT/US2012/058344 dated Mar. 28, 2013.
U.S. Appl. No. 13/436,403, Feb. 13, 2013, Office Action.
U.S. Appl. No. 13/436,403, Aug. 1, 2013, Final Office Action.
U.S. Appl. No. 13/866,569, Jun. 20, 2014, Notice of Allowance.
U.S. Appl. No. 15/426,756, Feb. 23, 2018, Office Action.
U.S. Appl. No. 15/987,366, Feb. 14, 2019, Office Action.
U.S. Appl. No. 16/709,674, Apr. 6, 2020, Office Action.
U.S. Appl. No. 29/648,685, Feb. 15, 2019, Ex Parte Quayle Action.
U.S. Appl. No. 29/648,685, May 9, 2019, Notice of Allowance.
Final Office Action received for U.S. Appl. No. 16/549,901, dated Mar. 12, 2021, 6 pages.
Notice of Allowance received for U.S. Appl. No. 16/549,901, dated Apr. 16, 2021, 8 pages.
Notice of Allowance received for U.S. Appl. No. 16/942,166, dated Nov. 23, 2021, 8 pages.
U.S. Appl. No. 13/436,403, filed Mar. 30, 2012.
U.S. Appl. No. 16/824,209, filed Mar. 19, 2020.
U.S. Appl. No. 62/722,591, filed Aug. 24, 2018.
U.S. Appl. No. 62/890,818, filed Aug. 23, 2019.
U.S. Appl. No. 62/991,889, filed Mar. 19, 2020.
U.S. Appl. No. 16/942,166, filed Jul. 29, 2020.
U.S. Appl. No. 29/744,477, filed Jul. 29, 2020.

* cited by examiner

LIGHT WEIGHT CONSTRUCTION SYSTEM BASED ON HORIZONTALLY PRE-SLOTTED PANELS

CROSS-REFERENCE TO RELATED APPLICATION

The present application claims priority to and the benefit of U.S. Provisional Patent Application No. 62/991,889, filed Mar. 19, 2020, which is herein incorporated by reference in its entirety. The present application is also a continuation-in part under 35 U.S.C. 120 of U.S. patent application Ser. No. 16/709,674 filed Dec. 10, 2019, which claims priority to and the benefit of United States Provisional Patent Application Nos. 62/777,648 filed Dec. 10, 2018 and 62/890,818 filed Aug. 23, 2019, each of which is herein incorporated by reference in its entirety.

BACKGROUND OF THE INVENTION

1. The Field of the Invention

The present invention is in the field of modular building construction methods and systems used within the construction industry.

2. The Relevant Technology

Building construction systems including modular features are sometimes used in the construction field. For example, particularly in third world countries where skilled labor is not readily available, and building materials must be relatively inexpensive, cinder block or brick materials are used in constructing homes, schools, agricultural buildings, and other buildings. It can be difficult to learn to lay block or brick while keeping the walls square and plumb. In addition, such systems require mortar to hold the individual blocks or bricks together. A roof formed from a different material (other than block or brick) is needed. In addition, insulating and/or providing an air-tight seal within such structures is difficult.

Stick frame construction methods are of course also well known, although such systems also require a considerable amount of skilled labor to construct a building therefrom. In addition to requiring skilled labor, such existing methods also require considerable strength for those involved in the construction. Because of such requirements, in practice, such construction systems are not readily usable by groups of both men and women, where women often make up the vast majority of the labor pool available in third world humanitarian construction projects.

Various other building materials and systems are also used in the art. Structural insulated panels (SIPs) are used in some circumstances within the construction industry as an alternative to stick frame construction with insulation blown or laid within the cavities between stick framing members. A typical structural insulated panel may include an insulating layer sandwiched between two layers of structural plywood or oriented strand board ("OSB"). The use of such panels within residential, commercial or other construction projects can often significantly decrease the time required for construction, and also typically provides superior insulating ability as compared to a traditional structure constructed of block or brick, or even stick frame construction with insulation blown or laid between frame members. That said, drawbacks with such systems is that stick frame construction and SIP construction typically require some level of skilled labor, and thus are not particularly well suited for use in environments where such skills are not readily available, and shipping such panels can represent a significant expense. In addition, heavy equipment (e.g., cranes) are often required to install such panels.

SUMMARY

In one aspect, the present invention is directed to various building construction systems and methods. Such systems and methods may employ a plurality of modular panels, which may be based on a common modularity within each panel. The system could also be a fractal system, e.g., where larger panels could be provided, based on multiples of such a base panel. In any case, the modularity and particular panel design of the system also allows the modular panels to be easily and quickly cut, where the building blueprints dictate the need for only a portion of the overall modular panel length. Such modularity characteristics will be apparent, in the following disclosure.

Furthermore, many existing systems provide excellent flexibility, but with that flexibility, there is significant room for error, such that skilled labor is required. Other systems that may employ a system of panels may reduce the room for error, but greatly reduce the available flexibility, necessitating use of many custom components and solutions to accommodate needs that the system does not anticipate. The present system provides a happy medium between providing flexibility, and requiring only little if any skilled labor.

A modular panel for use in construction may include a lightweight (e.g., foam) body, and one or more channels extending horizontally through a length of the panel. Each channel may be configured in size and shape to receive a flexible elongate spline therein, wherein each spline once received in the channel is at least partially disposed within the lightweight body, without the spline being exposed on the large outside planar face of the body.

One advantage of the present system is that the splines may simply be ripped strips of oriented strand board (OSB) or the like, which is readily available throughout nearly the entire world, and which is also more flexible in a direction that is normal to the width of the OSB spline (i.e., in the direction of its thickness), than would be typical for dimensional lumber, even of the same dimensions. For example, while Applicant has also developed earlier systems which use dimensional lumber as splines, it was found that because such lumber is notorious for being warped, it can be difficult to easily insert each spline into its corresponding channel, when a significant fraction of 2×4s or other dimensional lumber is warped. Flexible strips of OSB or similar material are far more easily inserted into the channels, as described herein. It is not necessary that the splines be formed of wood, although such works particularly well. It will be apparent that metal or other splines (e.g., steel or aluminum, plastic, etc.) are of course also usable, e.g., where it may be desirable to avoid the use of wood.

The channels may include pairs of top and bottom channels, offset from the center of the thickness of the foam body, for use in providing horizontally extending I-beams at the top and bottom of each channel. For example, stacked panels may include an I-beam that is formed in-situ, during construction of the wall, between such stacked panels. For example, as the panel is placed, the elongate splines are positioned in the top and/or bottom channels, another spline is positioned between such splines to form the central web portion of the I-beam (where the splines in the channels form the end flanges of the I-beam), and the next panel is stacked on top of the first panel. The bottom channels of the second panel receive initially exposed portions of the splines forming the end flanges of the I-beam inserted in the first panel, hiding these splines (and the I-beam) between and within the pair of stacked panels.

The panels may also include interior channels, as well as a pre-cut slot in a first face of the modular panel, centered on the interior channel, where the pre-cut slot extends through the thickness of the foam at the first face of the panel, into the interior channel. In other words, such a narrow pre-cut slot may provide access into the channel from one exterior face of the panel. The width of such a pre-cut slot may be relatively thin, to ensure that a spline that may also be inserted into such interior channel (e.g., providing a furring strip) remains restrained in the channel. For example, such a pre-cut slot may be no more than 0.25 inch, or no more than 0.125 inch wide, e.g., less than 20%, less than 15%, less than 10%, or less than 5% of the transverse cross-sectional length (e.g., a length of 2-6 inches may be typical) of the channel.

The opposite face of the modular panel may similarly include a pre-cut slot also aligned with an interior channel corresponding to the second (opposite) face of the panel, having similar characteristics as described above relative to the pre-cut slot in the first face of the panel. When it becomes necessary to cut a modular panel (e.g., where a wall being built requires only a portion of the length of such a "full" panel), this is easily accomplished, as the panel may be formed from expanded polystyrene ("EPS") or another similar insulative foam material.

The panels themselves are cut on a CNC controlled hot wire cutting device, which is capable of making very precise cuts, so that the panels themselves are very accurate in their geometry (e.g., to within 0.001 inch). Thus, the panels may be of any desired thickness, e.g., as dictated by the particular desired wall thickness. For example, a foam panel thickness of 5.5 inches may be equal in width to a 2×6 (which is actually 5.5 inches wide, rather than 6 inches wide). By way of further example, a panel corresponding to 2×8 dimensions may be 7.25 inches thick. A typical 7.25 inch thick foam panel may include channels cut with the CNC device that are sized to accept ½ inch or ⅝ inch thick OSB ripped splines, having a width of typically 2-6 inches (e.g., 3-4 inches), although it will be apparent that such dimensions could be varied, as needed.

The various channels may be off-center relative to the thickness of the foam body, and parallel to one another. For example, the various first channels may be positioned closer to the first face of the foam body, and the various second channels may be positioned closer to the second face of the foam body. Any of such channels may be generally rectangular in cross-section, with a length (i.e., the channel's height) of the transverse cross-section rectangle oriented vertically, for desired orientation of the flexible splines therein. As described above, an exemplary panel may include a pair of spaced apart top channels, exposed at the top end of the panel, a pair of spaced apart bottom channels, exposed at the bottom end of the panel, and optionally, a pair of interior channels, between the top and bottom channels. All such channels may receive splines during wall construction, and are configured so that such splines received therein are not exposed at the large planar exterior faces of the panel. The splines in the top (or bottom) channels may initially be exposed, until covered by the next panel, which is stacked over the initially placed panel. For example, the uncovered portion of splines positioned in the top channels becomes received in the bottom channels of the next panel, stacked over the first panel.

For example, first and second top channels extend horizontally through the length of the body, with the first and second top channels being aligned above the first and second interior channels, respectively. There may also be provided first and second bottom channels extending horizontally through a length of the body, where the first bottom channel is aligned with and below the first interior channel (and below the first top channel), and the second bottom channel is aligned with and below the second interior channel (and below the second top channel). The top and bottom channels may be exposed and open at their top and bottom edges respectively, of the body. Each of the top and bottom channels may be generally rectangular in cross section, with the length of the transverse cross-section rectangle oriented vertically, so that each top and bottom channel is configured to also receive a flexible elongate spline therein (e.g., of similar or identical dimension to the splines that may be received in the optional interior channels).

The panel may be configured to provide a horizontal I-beam at the top and bottom of the panel, so that the splines in the top channels become flanges of such a top positioned I-beam, and the splines in the bottom channels become flanges of a bottom positioned I-beam. A web center portion of each I-beam member can be positioned on a top (or bottom) edge of the foam body, so as to be positioned between the splines inserted in the top (or bottom) channels, so as to form I-beams at the top and bottom edges of the foam body. Such a construction results in horizontal I-beams running horizontally through the wall being constructed with such a building system. The panels can be positioned between adjacent vertical post members, such that there is actually no need at all for vertical stud members within the wall construction, although the building system is still fully compatible with existing building codes.

The present disclosure also relates to wall systems, as well as methods of construction that use modular panels such as those described herein. For example, such a wall system may include a plurality of modular panels such as those described herein, in combination with a plurality of flexible splines that serve as interior splines, as well as forming the horizontally extending I-beam members at the top and/or bottom of each panel. The modular panels are typically of a size such that they will not provide the entire height of a typical wall or room being constructed (e.g., they may only be 2 or 4 feet high), but it will typically be required to stack such panels one on top of another to achieve a desired wall height. The top and bottom exposed channels of each panel may be of a depth such that they only receive a portion (e.g., about half) of the width of the spline being received therein, which will form the flange of the I-beam member. The adjacent channels of the next adjacent channel may receive the other portion of the spline. In other words, the top exposed channels may receive the bottom portion (e.g., bottom half) of the splines that form the flanges of the I-beam member positioned at the top of that panel, while another panel is positioned directly over the web of the I-beam member at the top of the first panel, into which the top portion (e.g., top half) of the splines that form the flanges of the I-beam member are also received. This arrangement may be repeated as necessary, depending on the desired wall height.

Another advantage of the present systems is that because the horizontal splines are generally restricted to movement within a single degree of freedom (only along the longitudinal direction of the channel—horizontally, either left to right), once the wall is assembled, it is not necessary that the splines inserted into a given channel be of a single, unitary piece of spline material. For example, scraps of OSB or other spline materials may be advanced or inserted into the channels, to make up the needed spline length. Such ability reduces on-site construction waste, as such small spline lengths may be simply pushed sequentially into the channel, forming the needed spline. There is typically no need to even attach such small spline segments together, although they could be attached to one another (e.g., glued, nailed, screwed, or the like) if desired. For example, they may simply become trapped in the interior channels of the panel, between adjacent posts of the wall. Such post members positioned between panels may be formed of dimensional lumber, or other standard dimensional material, steel, etc.

The present building systems may include a specially configured transition panel for making a transition from a wall (e.g., constructed using the standard panels described herein) to a roof structure. In an embodiment, the roof may similarly be constructed of the same standardized panels as the wall. Such a transition panel is similarly lightweight (e.g., formed from EPS foam). The transition panel may be formed as a single piece of lightweight foam material, forming a transition between the wall structure and the roof structure. The transition panel may similarly include channels for receiving splines as the standard wall panels described herein, for forming an horizontally extending I-beam between the transition panel and the top standard panel of the wall structure below. The transition panel may include another pair of exposed channels for receiving splines, for forming an I-beam between the transition panel and the adjacent roof panel (which may be a standard panel, identical or similar to the standard wall panel).

Such a transition panel may dictate the pitch of the roof structure, by having the desired pitch built into the panel, as the angle between the channels that engage with the adjacent wall panel, and the channels that engage with the adjacent roof panel.

The transition panel may also include any desired overhanging eave structure that overhangs the underlying wall structure. It is advantageous to be able to provide such an eave as part of the single piece transition panel (e.g., rather than assembling an eave from numerous components that are typically nailed/screwed together. In an embodiment, the transition panel may include slots into which stiffeners (e.g., OSB material) could be inserted. For example, such slots could be positioned in the overhanging eave portion of the panel so that when such stiffeners are inserted, they strengthen the foam in the eave portion of the panel, reducing any risk of damage to the eave.

Features from any of the disclosed embodiments may be used in combination with one another, without limitation. In addition, other features and advantages of the present disclosure will become apparent to those of ordinary skill in the art through consideration of the following detailed description and the accompanying drawings.

BRIEF DESCRIPTION OF DRAWINGS

To further clarify the above and other advantages and features of the present invention, a more particular description of the invention will be rendered by reference to specific embodiments thereof which are illustrated in the appended drawings. It is appreciated that these drawings depict only illustrated embodiments of the invention and are therefore not to be considered limiting of its scope. The drawings illustrate several embodiments of the invention, wherein identical reference numerals refer to identical or similar elements or features in different views or embodiments shown in the drawings.

FIG. 13 shows several transition panels, including a roof cap transition panel for transitioning from one side of a pitched roof apex to the other side; a wall-to-roof transition panel for transitioning from a wall to a roof; and a wall-to-floor transition panel for transitioning from a wall to a floor. A spline configured as an I-beam is also shown, e.g., for positioning between each given pair of panels (whether standard panel to standard panel, or standard panel to transition panel).

FIG. 14 illustrates a frame of the building system supported on pier footings.

FIG. 15 shows attachment of a spline between horizontal frame members, and positioning of the wall-to-floor transition panel for attachment to such spline.

FIG. 16 is similar to FIG. 15, after the flanges of the I-beam spline have been received into the corresponding slots of the wall-to-floor transition panel.

FIG. 17 shows positioning of a standard panel, as the first floor panel, positioned adjacent to the wall-to-floor transition panel, with the I-beam spline between the two panels (with flanges on either side of the I-beam received into slots of each of the corresponding panels).

FIG. 18 illustrates construction of the remainder of the floor, with standard panels, coupled together by splines between each set of panels, with the splines attached by ear brackets to the horizontal frame members.

FIG. 19 shows another wall-to-floor transition panel being positioned at the opposite end of the floor, for transitioning to a wall.

FIG. 20 shows the same configuration as FIG. 19, with the wall-to-floor transition panel now in place.

FIG. 21 shows an I-beam spline positioned into the top channels of the wall-to-floor transition panel, in preparation for placement of a standard panel thereover, for construction of the wall.

FIG. 22 shows a top standard panel of the wall in place, at the top portion of the wall, with a wall-to-roof transition panel being positioned for placement thereover, for providing a transition from the wall to the roof. In FIG. 22, a spline is being inserted into the free eave end of the eave portion of the wall-to-roof transition panel.

FIG. 23 is similar to FIG. 22, with the spline now inserted into the eave portion of the transition panel, showing the transition panel ready for positioning over the top standard panel (and its accompanying spline) of the wall, for providing a transition from the wall to the roof.

FIG. 24 is similar to FIG. 23, but shows the wall-to-roof transition panel now in place, with its wall leg (e.g., vertical wall leg) coupled by the spline, to the top-most standard panel of the wall.

FIG. 25 shows both sides of the pitched roof having been constructed with standard panels, joined together by I-beam splines (with the splines attached to the truss members of the frame), ready for capping of the apex by the roof cap transition panel.

FIG. 26 shows one side of the roof cap transition panel positioned for mating with one side of the pitched roof structure, with the opposite side ready for rotation downward, for mating with the other side of the pitched roof structure.

FIG. 27 shows the apex of the roof, after the roof cap transition panel is in place, forming the roof apex, joining together the standard panels that form either side of the pitched roof.

FIG. 28 shows the completed building construction.

DETAILED DESCRIPTION OF THE PREFERRED EMBODIMENTS

I. Definitions

Figure 1:
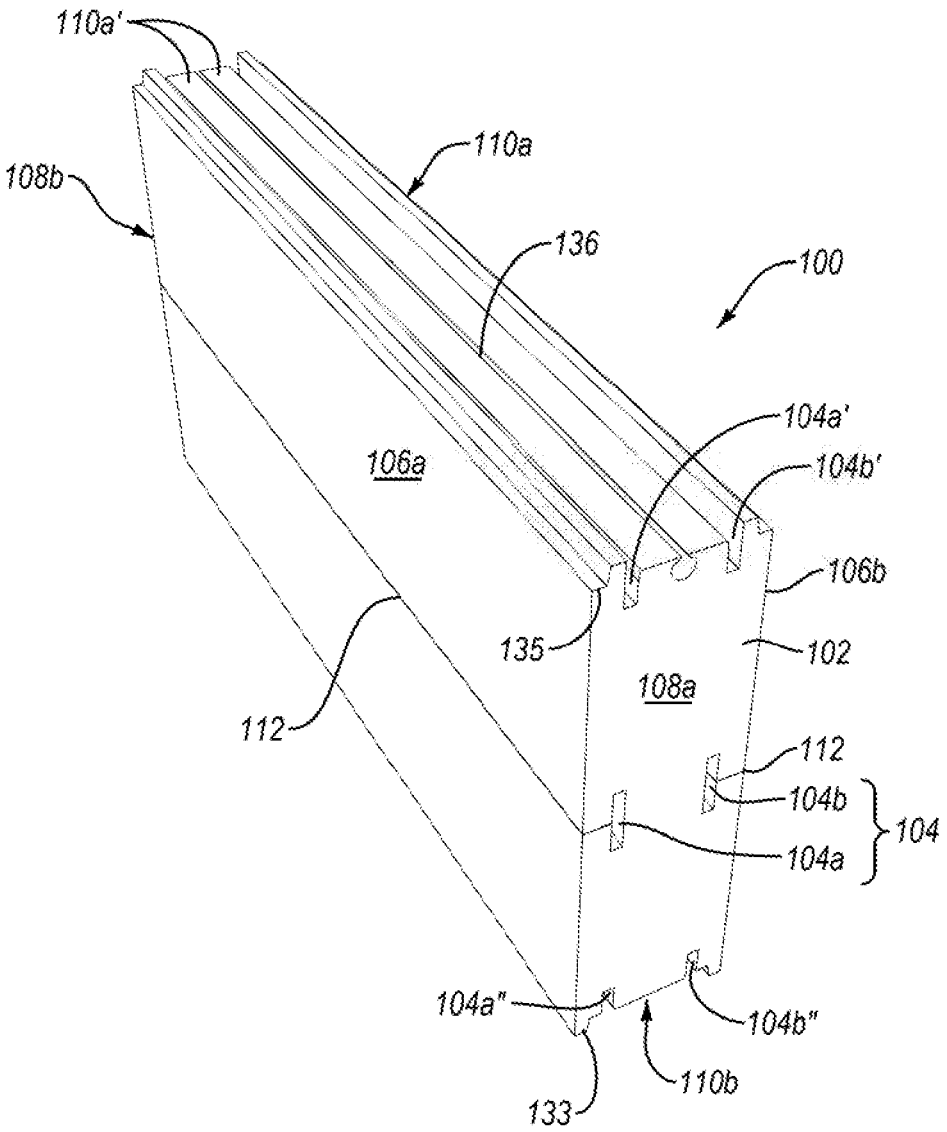
FIG. 1 is a top perspective view of an exemplary modular panel as described herein.

Some ranges may be disclosed herein. Additional ranges may be defined between any values disclosed herein as being exemplary of a particular parameter. All such ranges are contemplated and within the scope of the present disclosure.

Numbers, percentages, ratios, or other values stated herein may include that value, and also other values that are about or approximately the stated value, as would be appreciated by one of ordinary skill in the art. A stated value should therefore be interpreted broadly enough to encompass values that are at least close enough to the stated value to perform a desired function or achieve a desired result, and/or values that round to the stated value. The stated values for example thus include values that are within 10%, within 5%, within 1%, etc. of a stated value.

All numbers used in the specification and claims are to be understood as being modified in all instances by the term "about", unless otherwise indicated. Notwithstanding that the numerical ranges and parameters setting forth the broad scope of the subject matter presented herein are approximations, the numerical values set forth in the specific examples are reported as precisely as possible. Any numerical value, however, inherently contains certain errors necessarily resulting from the standard deviation found in their respective testing measurements.

It must be noted that, as used in this specification and the appended claims, the singular forms "a," "an" and "the" include plural referents unless the content clearly dictates otherwise.

Any directions or reference frames in the description are merely relative directions (or movements). For example, any references to "top", "bottom", "up" "down", "above", "below" or the like are merely descriptive of the relative position or movement of the related elements as shown, and it will be understood that these may change as the structure is rotated, moved, the perspective changes, etc.

All publications, patents and patent applications cited herein, whether supra or infra, are hereby incorporated by reference in their entirety to the same extent as if each individual publication, patent or patent application was specifically and individually indicated to be incorporated by reference.

II. Introduction

In one embodiment, the present invention is directed to modular building methods and systems where the building is constructed using lightweight foam modular panels in which the panels include one or more horizontal channels formed through the length of the lightweight foam body of the panel. The channels are configured to receive flexible elongate splines, which may simply be flexible strips of OSB, plywood, or the like. It will be appreciated that such splines do not necessary need to be formed of wood, such that metal splines, or even other materials (e.g., plastic, or otherwise) could be used. The splines and associated channels into which they are received are configured so that the splines are not exposed on an outside face of the lightweight body, but so that the spline is restrained in the wall (e.g., it can only slide in and out of the channel once placed—with 1 degree of freedom).

The channels may be configured to provide an interior horizontally positioned I-beam in a wall constructed with such panels, where each horizontal I-beam is positioned between vertically stacked panels. The flanges and web of each I-beam may be formed from the flexible elongate splines, such that the I-beam is not prefabricated, but is actually assembled in-situ, at the construction site, as the panels are positioned to build the wall structure. The horizontal I-beams may form part of a post and beam wall system, which the building system is particularly suited for. For example, the modular panels may be positioned between appropriately spaced apart vertical post members, while the horizontal I-beams run horizontally, between vertically stacked modular panels (i.e., along the wall's length).

The panels may include channels for additional horizontal splines, beyond those that form the I-beams between vertically stacked panels. For example, the panels may include top and bottom channels which receive splines, which become the flanges of the I-beam. The panels may also include interior channels, e.g., positioned off-center relative to a thickness of the foam panel, towards the first and opposite second faces of the panel (which faces correspond to the inside and outside of a constructed wall structure). Such interior splines may serve as furring strips, for attachment points for nails, screws or the like, e.g., for sheathing or other material positioned over the wall, away from the panels top and bottom edges.

The modular panels may have a thickness (e.g., foam thickness) that is typically greater than 4 inches, e.g., 5.5 inches, (the same width as a 2×6) or 7.25 inches (the same width as a 2×8). Because the panels include a cross-sectional geometry that is consistent across the length of the panel, they provide excellent flexibility in constructing any desired wall structure or building. For example, the foam panels may easily be cut off at whatever appropriate length, where the wall ends, or where a door, window or other opening is needed, in the horizontal direction of the wall. The vertical direction of the wall is easily formed by simply stacking a desired number of the panels on top of one another, forming the in-situ formed I-beams between each pair of stacked panels. Where desired, the top of a top-most panel could also be cut off, to accommodate an overall desired wall height, or the top-most standard wall panel may be topped with a transition panel that is configured to connect the wall panels to roof panels. Such a transition panel may include a wall portion that engages with the top-most wall panel, making up any desired additional wall height, allowing a user to accommodate any desired wall height.

The modular panels can be formed on a CNC hot wire cutting device, where all necessary deep cuts are formed (as it can be difficult to accurately cut foam material thicker than about 2 inches without such a device). Because the panels are formed under such conditions, during manufacture, high precision and accuracy are possible (which is not practical to achieve on a job site). Furthermore, by cutting the panels on such a CNC device, the rectangular panels themselves can be formed to very high precision and accuracy dimensions. For example, a 2 foot by 4 foot panel, 5.5 or 7.25 inches thick will be perfectly "square" and plumb, allowing the panel itself to be used as a square, level, or jig. This characteristic greatly reduces the need for skilled labor, as the panel itself serves as a template (i.e., no tape measure or square is needed). This helps to ensure a robust composite structure having the proper geometry (e.g., right angled walls where such is desired, level floors, level ceilings, and the like).

The present methods and systems of assembly allow for relatively open source construction, with a relatively high degree of customizability to the building being constructed, all achievable at lower cost and/or time as compared to existing methods of construction. Furthermore, even with such relative flexibility, little if any skilled labor is required. For example, a model or blueprint image of the building to be constructed could simply be provided, with the crew only being required to connect the modules as shown in the model or blueprint (e.g., akin to LEGO instructions)

It is also advantageous that the foam material (e.g., expanded polystyrene, or other foamed insulative materials) from which the modular panels are constructed may be readily available nearly anywhere, such that the foam panels may be manufactured at a foam production facility near the construction site (minimizing shipping distance and expense). This provides savings and convenience in that the foam panels can be manufactured locally, avoiding the significant expense of shipping foam (which occupies a large volume, even though it weights little).

For example, such foam may typically have a density from about 1 $lb/ft^3$ to 2 $lb/ft^3$, and provide an insulative value of about R4 per inch of foam thickness. A wall constructed using a 5.5 inch or 7.25 inch thick foam panel as described herein may provide an R value of about R25 or R30, respectively.

III. Exemplary Construction Methods and Systems

Figure 2:
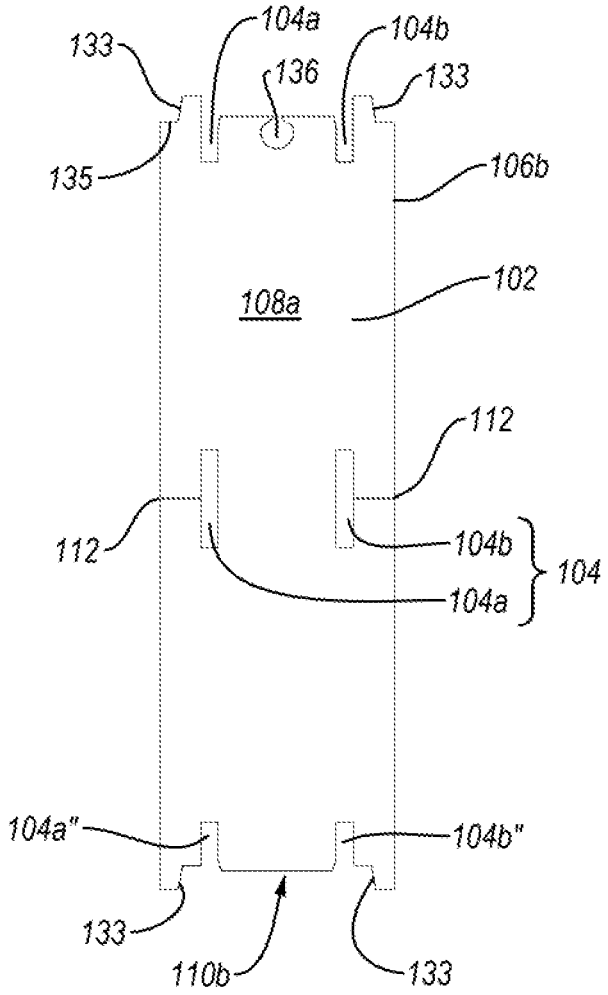
FIG. 2 is an end view of the modular panel of FIG. 1.
Figure 3:
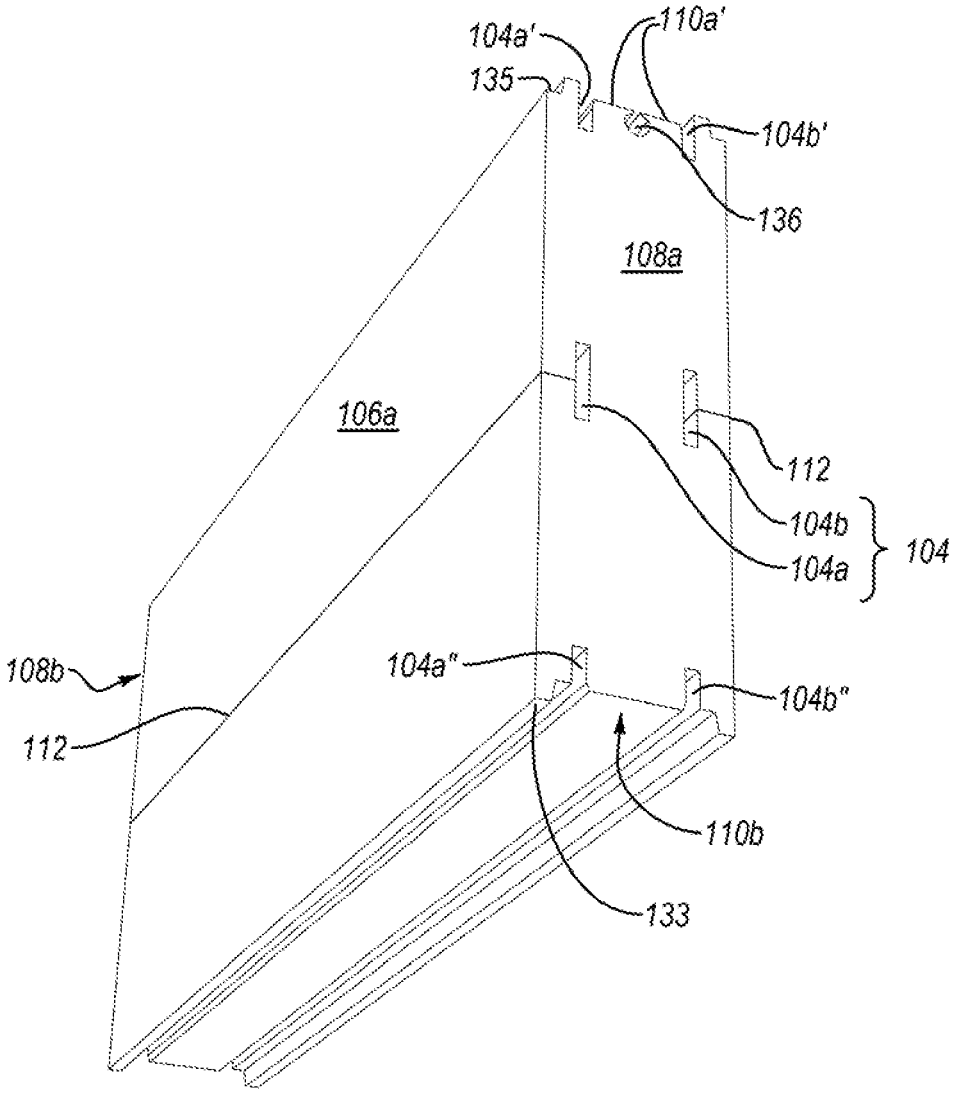
FIG. 3 is a bottom perspective view of the modular panel of FIG. 1.

FIGS. 1-3 show a modular panel 100 according to the present invention. Such panels can be used in building construction, and advantageously are typically fully compatible with existing building codes and standard construction practices, such that adoption of such a building system would not present the many regulatory and other hurdles associated with various other construction systems that have been proposed, some by the present Applicant.

Modular panel 100 includes a lightweight body 102. Body 102 may comprise or otherwise be formed from a foam material, such as expanded polystyrene (EPS) foam. Such material may be rigid. Such panels may be precision cut from blocks of rigid, already cured EPS foam. For example, EPS foam is often available as 3×4×8 foot blocks. Such a block may be sufficient to produce several modular panels as shown in FIG. 1, which may each measure 2×4 feet, with a thickness of 7.25 inches (width of 2×8 dimensional lumber). While EPS foam may be particularly appropriate, other lightweight materials that can be molded (as the 3×4×8 foot EPS blocks are molded), easily cut using CNC hot wire cutting device, etc. may also be used.

Each panel 100 includes one or more (e.g., a plurality of) channels 104 extending horizontally through the length of panel 100. In the illustrated configuration, panel 100 includes first and second interior channels 104*a*, 104*b*, each of which is positioned off-center relative to the thickness of foam body 102, with channel 104*a* positioned towards (i.e., closer to) panel face 106*a* and channel 104*b* positioned towards panel face 106*b* (i.e., closer to panel face 106*b* than the center of the thickness of foam body 102). Panel 100 also includes top and bottom channels, which will be discussed in further detail hereafter. In an embodiment, such a panel may actually not include the interior channels 104*a*, 104*b*, but only the top and bottom channels (i.e., the interior channels are optional). Each of channels 104*a*, 104*b* is sized and shaped to receive therein a flexible elongate spline, where the channels 104*a*, 104*b* are not open at faces 106*a* and 106*b* of panel 100, but are only open at left and right ends 108*a*, 108*b* of panel 100. In an embodiment, splines 116 are advantageously not dimensional lumber, which although readily available, is notorious for being warped, making it difficult to slide such a spline through channels 104*a*, 104*b*. Rather, splines may be formed from oriented strand board ("OSB"), plywood, or another material that is easily inserted into such a channel, and exhibits significant flexibility in the direction of the thickness of such sheet material. Such flexibility is readily apparent when holding such a strip of such sheet material at one end, as the other end will flex significantly downward under the weight of the sheet or strip alone. Such does not occur to the same degree with dimensional lumber, even in the same dimensions, as such dimensional lumber is significantly more rigid. Such OSB or similar spline materials are easily obtained, e.g., by ripping sheets of OSB or the like, which are as readily available as dimensional lumber, but with better flexibility in such direction, while exhibiting minimal if any warping. Although such OSB strips are a particularly suitable material, it will be apparent that a variety of other wood, plastic, or even metal materials could alternatively be used for splines.

Channels 104*a*, 104*b* within panel 100 have dimensions just slightly larger than those of the elongate spline so as to not bind within the channel, but so as to be freely slidable therein (e.g., a clearance of 1/16 inch or so, as will be apparent to those of skill in the art, may be provided). FIG. 1 also illustrates the presence of reduced-size (e.g., half-size) top channels 104*a*' and 104*b*' at top end 110*a* of panel 100, and reduced-size (e.g., half-size) bottom channels 104*a*" and 104*a*" at bottom end 110*b* of panel 100. Such reduced-size (e.g., half-size) channels may be similar to interior channels 104, but are exposed at the top or bottom of the panel (although not exposed at the panel faces 106*a*, 106*b*), and may be intended to accommodate similarly sized splines that run through the reduced-size channel (e.g., half height), and another reduced-size (e.g., half-size) channel of an adjacent panel 100 stacked above or below the illustrated panel, when constructing a wall. Such splines in top and bottom channels 104*a*', 104*b*', 104*a*" and 104*b*" may form the flanges of an I-beam which is horizontally positioned, between adjacent stacked panels. Splines within interior channels 104 may not form part of an I-beam, but may serve as furring strips providing excellent attachment points within the panel, e.g., when securing drywall or other sheathing material over one or both panel faces 106*a*, 106*b*. Such splines in interior channels 104 may thus be optional, and may also increase the strength characteristics (e.g., shear) of the resulting wall, where included.

The channels (particularly top and bottom channels 104*a*', 104*b*', 104*a*" and 104*b*") which are associated with the internal horizontally extending I-beams that are formed in-situ, as the wall is assembled may be spaced apart from one another to accommodate any particular desired spacing of such I-beams, as dictated by the height of each modular panel. For example, in the illustrated configuration where the panel 100 is 2 feet high, such I-beams will be provided horizontally, 2 feet apart, between adjacent panels. Taller or shorter panels could be provided where it is desired to adjust such spacing. Similarly, the panel length (e.g., 4 feet) may dictate the spacing of adjacent vertical posts in the wall, which may be provided between adjacent panels placed side by side (while I-beams are provided between adjacent panels stacked one on top of another). Spacings other than 4 feet (e.g., 8 feet, 12 feet, etc.) for such posts, and for the panel length may be possible. Such spacing characteristics are well accepted within the building industry, and compatible with existing building codes, which allows the present panels and systems to be readily accepted and implemented, once made known by Applicant. Importantly, when a spline is received into any of the channels (104*a*, 104*b*, 104*a*', 104*b*', 104*a*" or 104*b*"), the spline is not exposed on either exterior face 106*a* or 106*b* of panel 100. Applicant has found that other systems that provide for structural members or other features that are exposed on the exterior of a panel exhibit a "ghosting" problem, in that even once such structures are finished over, because of the different material characteristics underlying drywall or other sheathing associated with such surface exposure at the face during framing, there is a noticeable "ghost" that shows up through paint or other interior or exterior wall finishes that plague such systems. It is thus important that no such spline surface exposure is provided with the present panels. The full interior and exterior faces 106*a*, 106*b* are provided entirely by the material from which the lightweight foam body is formed (e.g., EPS).

In addition to "ghosting" issues, exposure of splines on the exterior surface also can result in thermal bridging problems, e.g., particularly where metal sheathing is present (e.g., on a roof or otherwise). By ensuring that the splines are positioned internally, rather than externally exposed, there is less of a problem of thermal bridging through the wall, which increases overall insulative efficiency of the wall, roof or other building structure constructed therefrom. Where thermal bridging occurs, undesired condensation can often occur in such spots due to a thermal gradient associated with such thermal bridging. The present systems ensure there is a thermal break between such structural spline members and any metal or other sheathing that may eventually be placed over roofs, walls, or the like.

Furthermore, because the splines are positioned within the panel thickness, with approximately 1 to 2 inches of foam thickness between the spline and the nearest face, building codes do not require that electrical wiring (e.g., 120V) be run within conduit, as there is at least 1.5 inches between the exterior of any sheathing (e.g., ½ inch or ⅝ inch drywall or the like) applied over the panel and such electrical wiring. In addition, as shown in FIG. 1, the panel may actually include an internal raceway 136 for receipt of electrical wiring, etc.

In FIG. 1, channels 104*a*, 104*a*' and 104*a*" are all vertically aligned with one another, spaced an equal distance from the face 106*a* of panel 100. Similarly, channels 104*b*, 104*b*' and 104*b*" are all also vertically aligned with one another, spaced an equal distance from face 106*b*. Because the channels are not centered in the panel's thickness, but are offset towards the respective faces, two such channels are provided at a given height, horizontally aligned with one another (e.g., channels 104*a* and 104*b* are at the same height, channels 104*a*" and 104*b*" are at the same height, and channels 104*a*' and 104*b*' are at the same height). While it may be possible to flip the panel 90°, such that the I-beams would run vertically, the illustrated horizontal orientation of the panel (horizontal length greater than vertical height) is particularly advantageous in wall construction, as most variation in wall constructions occurs horizontally, rather than vertically (e.g., most walls are of a given height, with little variation beyond such standard heights). The channels are offset towards one of the two faces 106*a*, 106*b* of the foam body 102, with two channels at each given height (e.g., interior channels 104*a*, 104*b* are at a central portion (e.g., the middle) of the height, channels 104*a*" and 104*b*" are at the bottom of the panel, and channels 104*a*' and 104*b*' are at the top of the panel. Because 2 channels are present at any given height, equally spaced from their respective faces, the same length fasteners can be used to attach sheathing on one face of the panel versus the other face.

In any case, when attaching such drywall or other sheathing, the present system avoids point loading onto screws, nails, or other fasteners employed, because of the foam thickness (e.g., 1 to 2 inches) between the sheathing and the spline encased within the foam panel. Such avoidance of point loading can be beneficial in an earthquake or the like, which may otherwise cause such fasteners to shear off.

In addition to the various internal, top and bottom channels described, the illustrated panel 100 further includes a pre-cut slot 112 in face 106*a* of panel 100, centered relative to channel 104*a*. Pre-cut slot 112 extends from first face 106*a* into channel 104*a*. For example, such a pre-cut slot allows internal formation of channel 104*a* in body 102 with a CNC controlled hot wire cutter. The width of slot 112 is advantageously very narrow, e.g., rather than providing a wide opening from channel 104*a* to the area adjacent face 106*a*. For example, where the height of channel 104*a* may be just over 3 inches (e.g., to accommodate a 3 inch spline), the width of slot 112 (the width of which is parallel thereto) may be no more than 0.25 inch, or no more than 0.125 inch. Stated another way, the width of slot 112 may be no more than 20% of, 15% of, 10% of, or no more than 5% of the transverse cross-sectional height of channel 104*a*. On the face 106*b*, opposite face 106*a*, there is shown another pre-cut slot 112, identically configured, but with respect to channel 104*b* and face 106*b*. The alignment of slots 112 with interior channels 104 is further beneficial once a wall structure has been built, where the panels are stacked one over another, as the channels and splines may no longer be visible. The slots 112 are visible in such circumstances, allowing a user to quickly and easily see where the splines are located within a given wall structure. Such slots 112 make attachment of drywall or other sheathing over the foam panels very easy, as the slots 112 mark the location of the center of the splines, which are easily nailed or screwed into, through the thickness of the foam between channels 104 and each respective face 106*a*, 106*b*. As internal channels 104*a*, 104*b* are optional, if they are not included, the such pre-cut slots may also be omitted.

Figure 4:
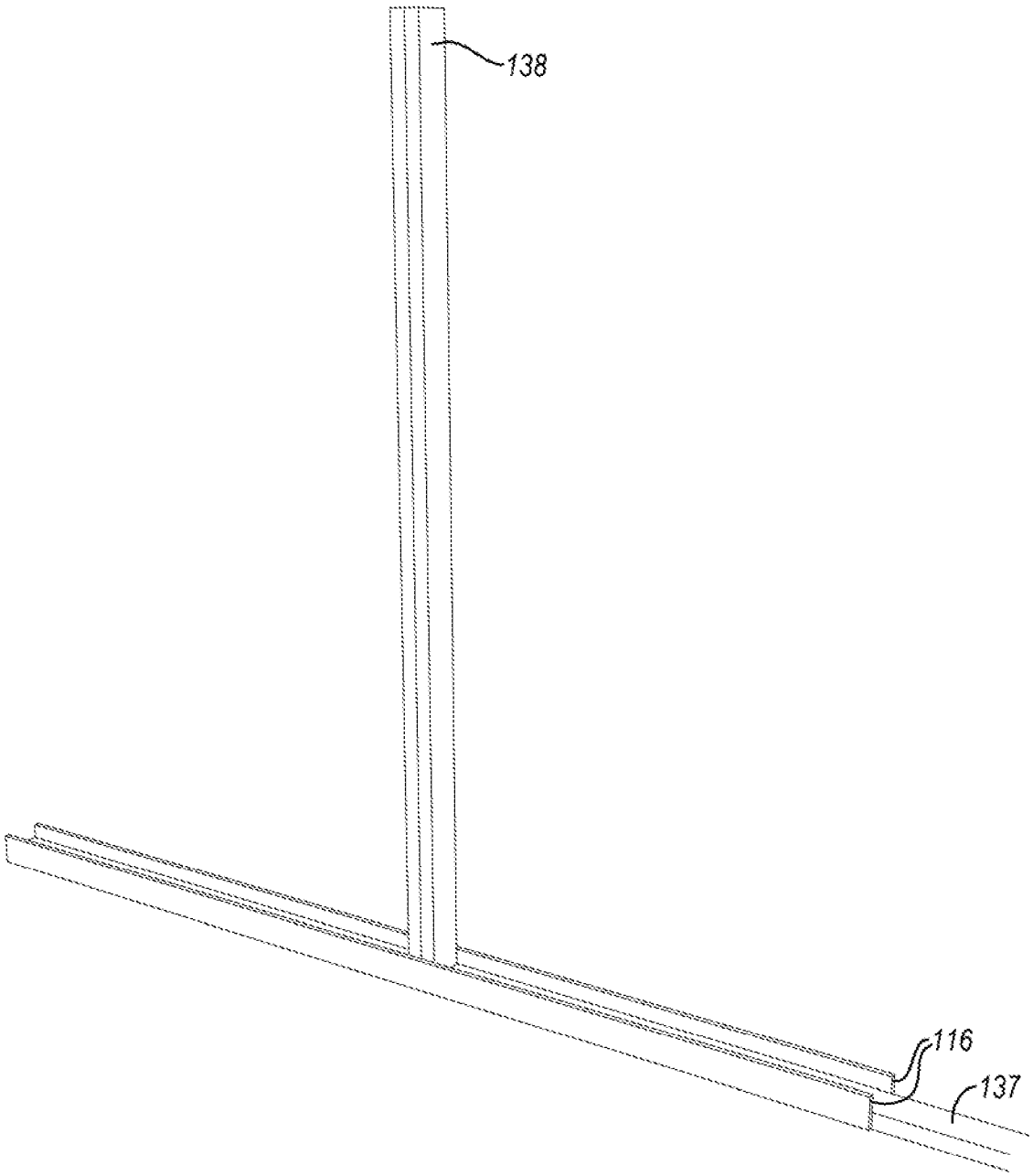
FIG. 4 is a perspective view showing a vertical post against which the modular panel can be positioned and attached to, as well as a bottom plate and bottom flange splines, for reception into a first layer of placed modular panels.
Figure 5:
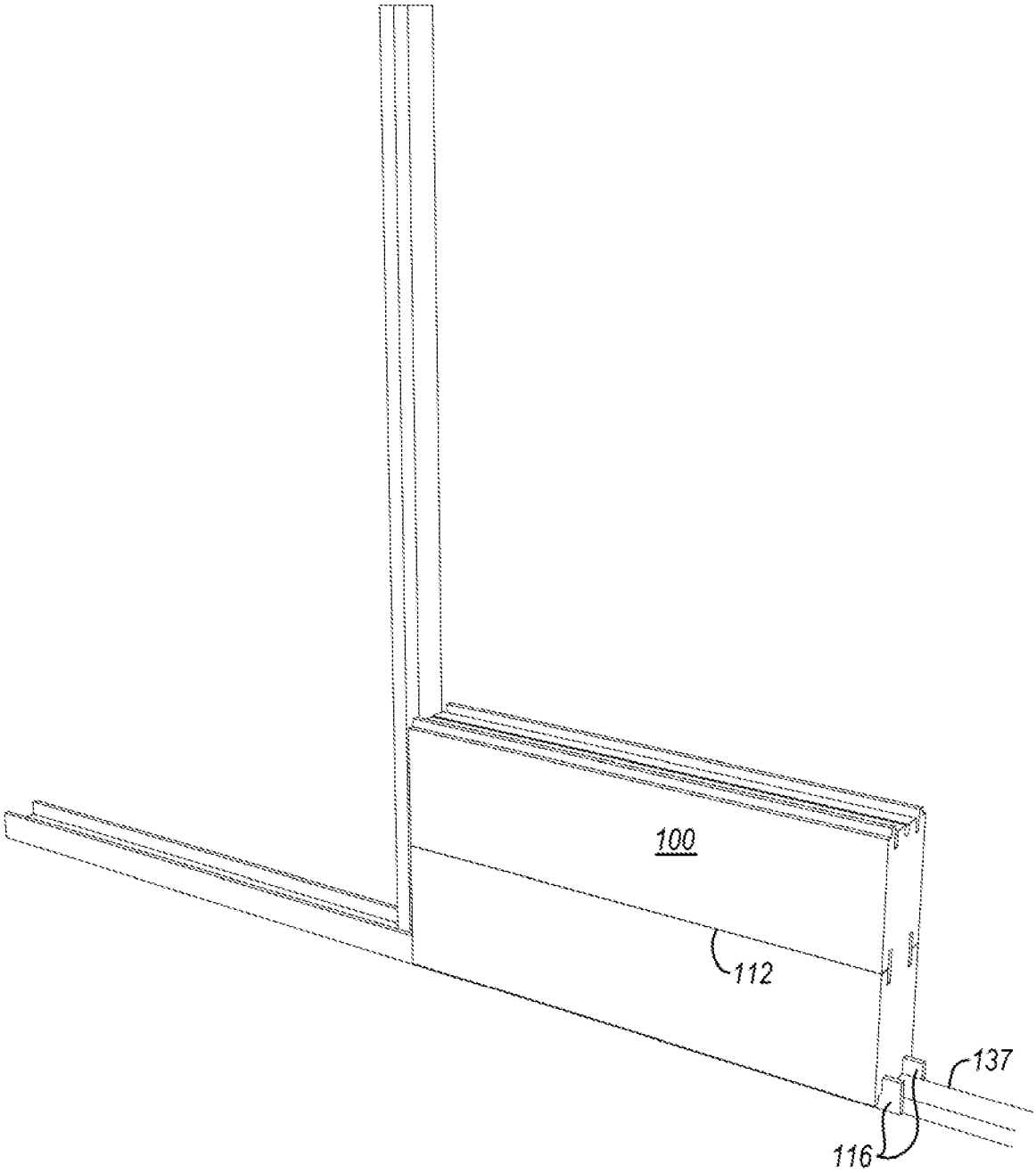
FIG. 5 is a perspective view showing the vertical post, bottom plate and bottom flange splines of FIG. 4, with a modular panel positioned over the bottom plate, with the splines inserted into the bottom channels of the modular panel.

FIGS. 4-8 show progression of construction of a wall structure using a plurality of such panels 100, in a post and beam type construction. The horizontal beams are provided by in-situ formed I-beams, that are initially provided to the construction site prior to installation as lengths of separate OSB or similar elongate spline material, which splines are positioned in channels or on top and/or bottom of such panels to form the I-beams in place, as the wall is constructed. The vertical posts of the system are placed between adjacent panels oriented side by side, for the wall. In FIG. 4, there is shown a vertical post 138 (e.g., two 2×4s), positioned on a bottom plate 137 (e.g., a 2×4, other dimensional lumber, or the like) sandwiched between two splines 116 (which splines 116 will be inserted into bottom channels 104*a*" and 104*b*") of panel 100. FIG. 5 shows one panel 100 in place relative to vertical post 138, bottom plate 137 and bottom splines 116.

Figure 6:
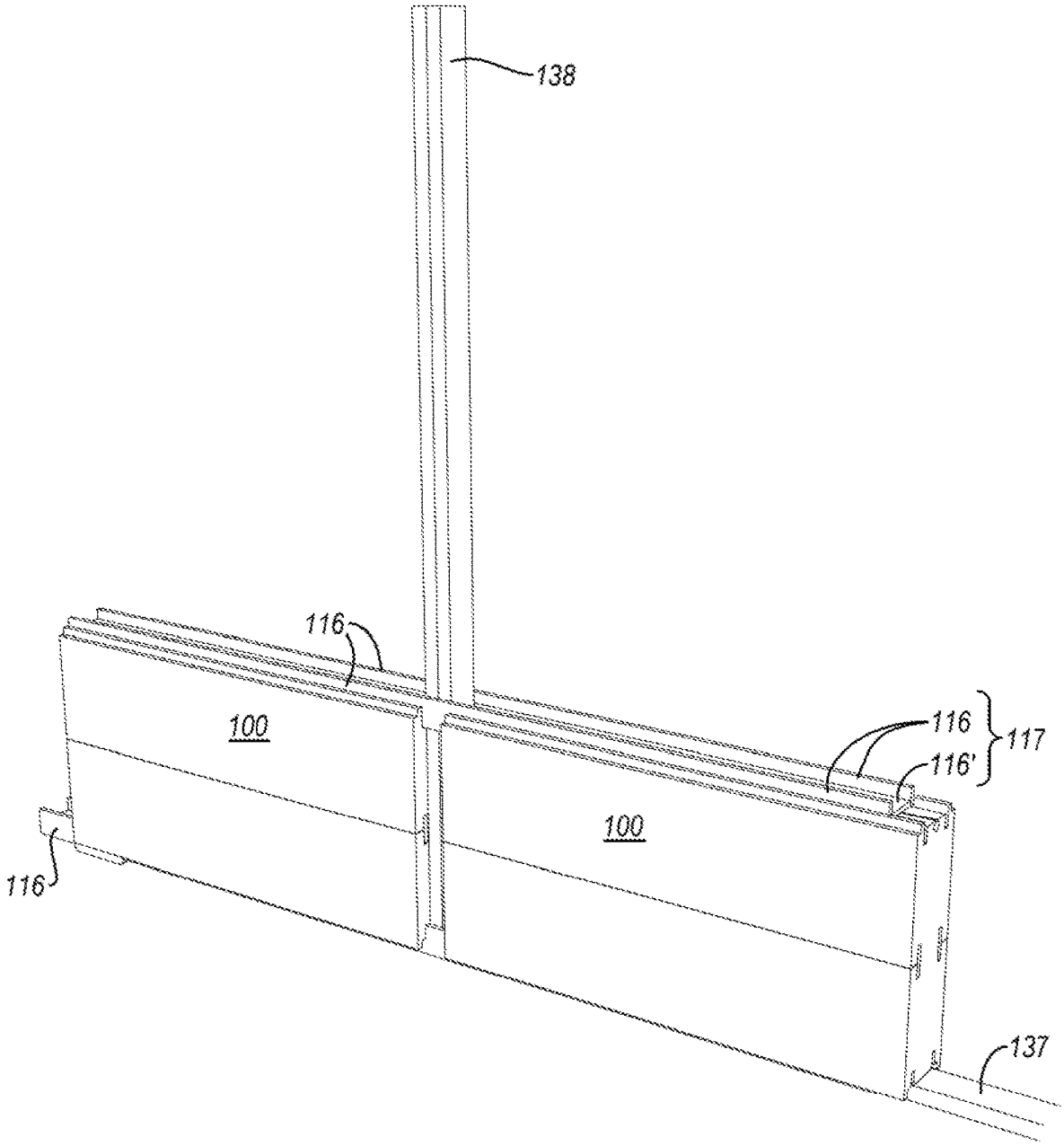
FIG. 6 is a progression from FIG. 5, showing placement of another panel on the opposite side of the post, showing how the various splines may span across both modular panels, sandwiching the post between the splines, and also showing splines positioned to form an I-beam formed from components placed into the top channels, and over the top of the modular panel.

FIG. 6 shows two panels 100, positioned side by side, with vertical post 138 there between, separating the panels 100. FIG. 6 also shows the 3 components for the in-situ formed I-beam positioned on the top of panels 100. The vertical flanges of the horizontally extending I-beam are provided by splines 116 positioned in top channels 104*a*' and 104*b*', while the web 116' of the I-beam 117 is provided by another spline (e.g., also an elongate strip of OSB or other suitable material), laid on the top planar edge 110*a*' at the top of panel 100. The web spline 116' has a width equal to the spacing between top channels 104*a*' and 104*b*', so as to span the distance between splines 116 placed therein, so that the two splines 116 (flanges of I-beam 117) and web 116' together form the I-beam. The 3 pieces of the I-beam 117 may be inserted one at a time, and glued together where such members 116, 116' contact one another (i.e., the sides of web 116'). Glue may also be applied in channels 104*a*' and 104*b*' and on planar surface 110*a*', to secure the I-beam 117 within panel 100. A panel could be provided with web spline 116' already glued or otherwise secured to the top planar face 110*a*' of panel 100, if desired. A pre-assembled I-beam could also be used.

While web spline 116' may only have a length that is equal to that of the panel 100 (e.g., 4 feet), the splines that form the flanges of the I-beam 117 may have a length greater than the panel, so as to extend across the vertical post 138, as shown in FIG. 6. Splines 116 of I-beam 117 could be nailed, screwed, glued, or otherwise secured to vertical post 138 at this junction, between adjacent side-by-side panels 100. In an embodiment, shorter splines could also be used, e.g., but still span from one panel 100, across vertical post 138, to the adjacent panel 100 (e.g., length of 4 feet, or even less). It is not necessary that the flanges of the I-beam be formed from single continuous pieces of OSB or other suitable material. For example, short lengths of OSB waste material, which could be short pieces (e.g., 1 foot, 2 feet, 3 feet, 4 feet, etc.) could be fed into channels 104*a*', 104*b*' to form each flange of the I-beam 117. Because such short lengths would be constrained within stacked top and bottom channels (e.g., 104*a*' and 104*a*"), and may be glued in place, they will provide a sufficiently strong I-beam for the post and beam wall construction systems described herein.

Figure 7:
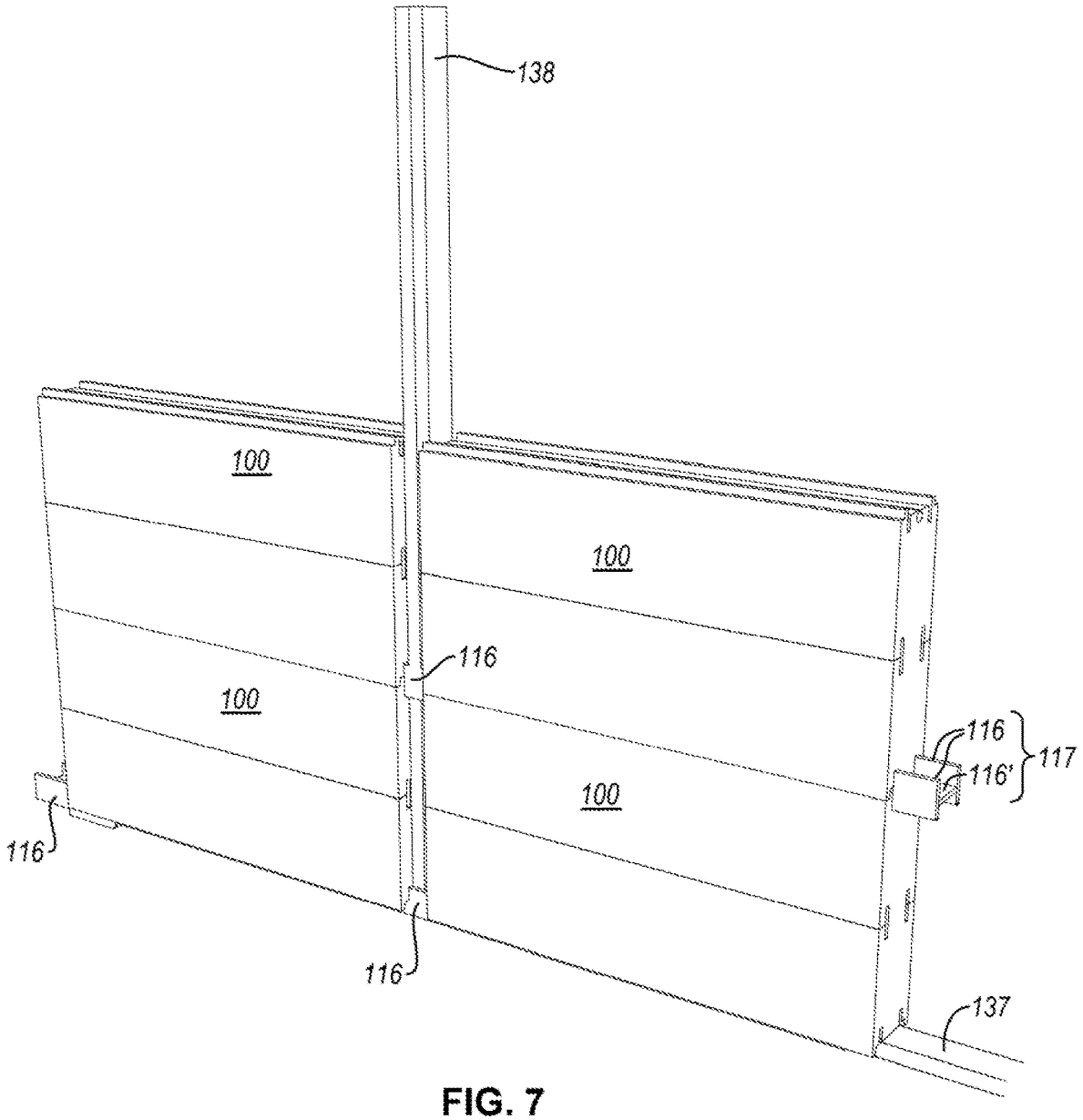
FIG. 7 is a progression from FIG. 6, showing placement of an additional stack of panels over the first layer of panels, with an in-situ formed I-beam constructed on site, therebetween.

FIG. 7 shows a further progression of the wall construction, now with 4 panels 100, two side-by-side, and two stacked one on top of another. There is no need to stagger seams between panels, although they could be staggered, if desired. While FIGS. 5-7 do not show splines 116 inserted into interior channels 104 of the panels 100 in order to better show other features, it will be appreciated that splines 116 can be inserted into any or all of such interior channels 104, as desired.

Figure 8:
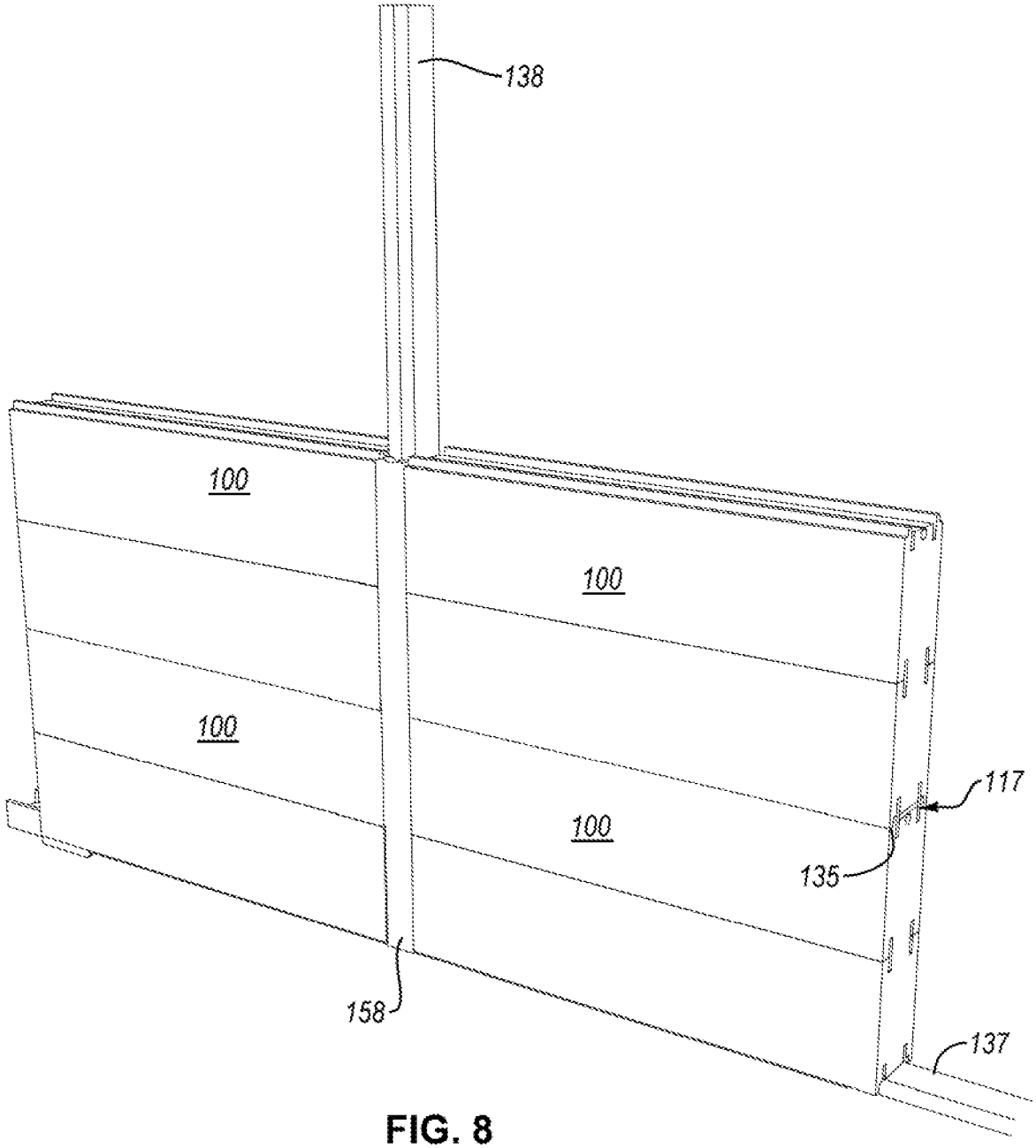
FIG. 8 is a progression from FIG. 7, showing a foam filler member installed over the vertical post, creating a flush surface across the panels on either side of the post.

FIG. 8 is similar to FIG. 7, but shows a filler piece 158 of foam positioned over the vertical post 138, to fill the gap between adjacent side by side positioned panels 100. For example, the illustrated wall may be 2 panels wide, and 2 panels high (e.g., about 8 feet long, 4 feet high). By stacking another 2 heights of panels, the wall may be 8 feet high. Any height may be achieved by simply stacking the needed number of panels, with an I-beam horizontally oriented between each set of stacked panels. Any length may be provided to such a wall, by simply placing additional vertical posts (e.g., at 4 foot intervals, or other interval), with one column of panels positioned between such posts. As is further evident from FIG. 8, where one panel 100 is stacked on top of another panel 100, there is an overlap profile between the adjoining panels at the seam 135, which prevents water from entering at what might otherwise be a simple horizontal seam between such stacked foam panels. In other words, the top and bottom outer edges of each panel include a stair stepped configuration at 133, as perhaps best shown in FIGS. 1-3, so that the horizontal seam 135 (FIG. 8) is followed by an inclined or stair-stepped surface, preventing water from seeping into channels 104*a*', 104*b*', 104*a*" or 104*b*".

Any of the splines may be more securely retained within any of the channels with any suitable adhesive. Without use of such an adhesive, the building system may actually be reversible, allowing dis-assembly of the components in a way that allows them to easily and quickly be re-assembled, e.g., at a different time, or in a different location. Such characteristics may be particularly beneficial for temporary structures (e.g., emergency housing, sets for plays or other drama productions, and the like). Where an adhesive is used, such adhesive may be injected into the channel through pre-cut slot 112 (for channels 104), injected directly into the open top or bottom channels (for channels 104*a*', 104*b*' 104*a*" or 104*b*"), or placed on the splines 116, prior to channel insertion. Once drywall or other sheathing is placed over the foam panel faces 106*a* or 106*b*, nails or screws may further be used to secure such sheathing to the splines 116 within any of such channels.

As described above, the splines 116 may have a length that is greater than the length of a given modular panel 100, such that a single spline 116 runs through aligned channels (similarly numbered) of more than one modular panel, positioned side by side. FIG. 8 further shows how once the splines 116 are inserted into any of the various channels, splines disposed therein are not exposed on the outside faces 106*a*, 106*b* of the foam bodies of panels 100. The splines are constrained within their channels, having only 1 degree of freedom therein (i.e., the ability to slide within the channel).

Figure 9:
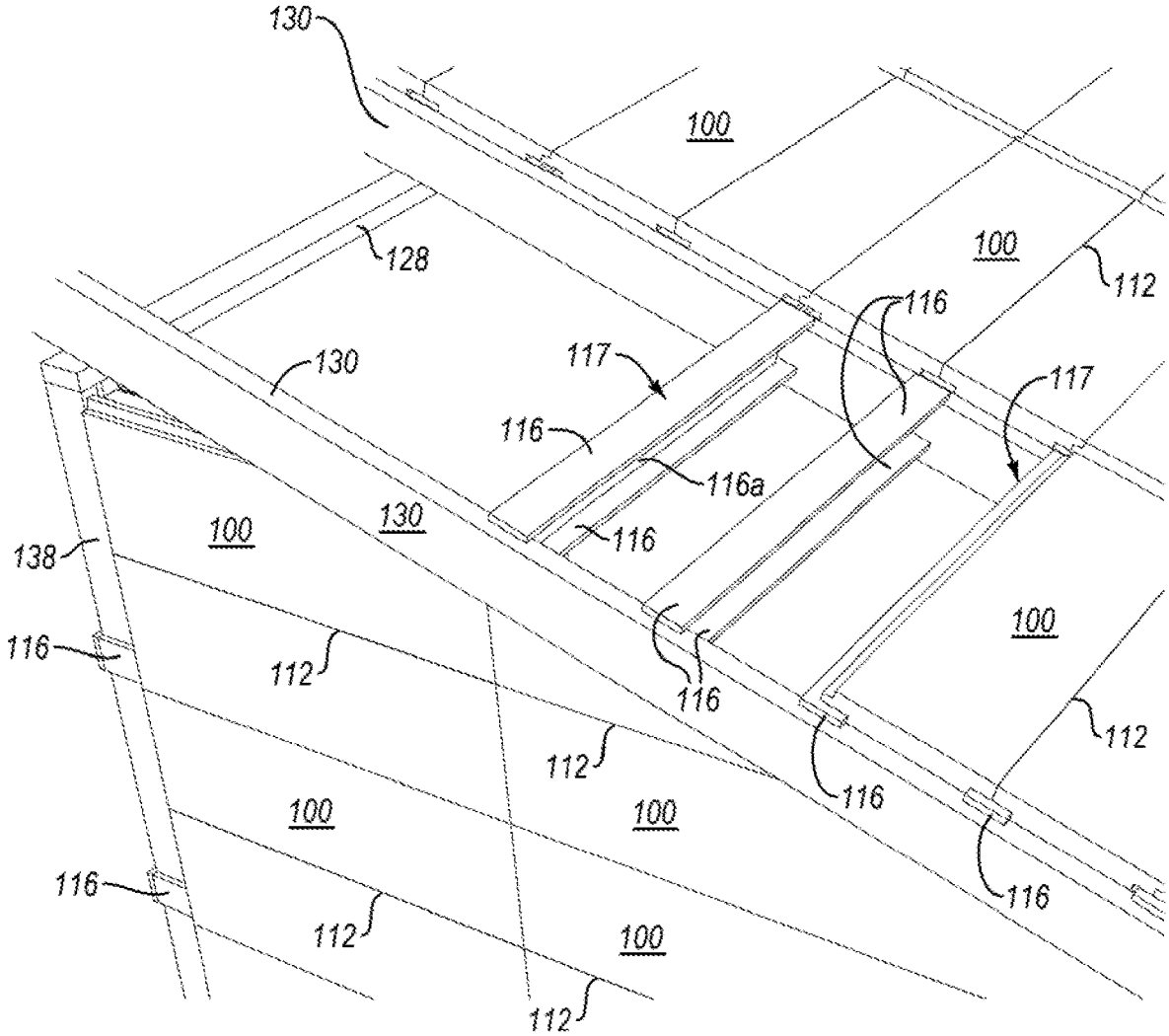
FIG. 9 shows a wall constructed similar to that of FIG. 8, further showing how the same panels may be use for a roof, positioned between truss members.

Many of the following Figures described hereafter show various configurations and uses in which the panels, splines, and building systems may be employed, as well as methods of use therefore. FIG. 9 shows a wall formed from a plurality of panels 100, as well as how the panels may be used to form a roof structure, with panels positioned between adjacent truss members 130. In a similar manner as with the wall structures seen in FIGS. 5-8, I-beams 117 may be provided between adjacent stacked panels 100, while additional splines 116 may be provided, in interior central channels 104. The splines 116 in any such channels may extend beyond the length of each panel, for attachment to truss members 130, as shown. The truss members may simply be spaced apart at a distance equal to the length of the panels (e.g., 4 feet). The wall may include a cap plate 128, as shown (e.g., to which truss members 130 may be attached).

Any desired roof pitch may be accommodated by such construction. Exemplary pitches include any desired pitch ratio, such as from 12/1 to 12/18 (e.g., 12/1; 12/2, 12/3; 12/4; 12/5; 12/6; 12/7; 12/8; 12/9; 12/10; 12/11; 12/12; 12/13; 12/14; 12/15; 12/16; 12/17; or 12/18). Another roof configuration using a transition panel is shown and described hereafter, in FIG. 11. A flat roof is of course also possible. As shown in FIG. 9, where roof panels 100 may not extend down the full height of trusses 130, any unfilled space below panels 100 can be used for electrical and/or plumbing runs.

Figure 10:
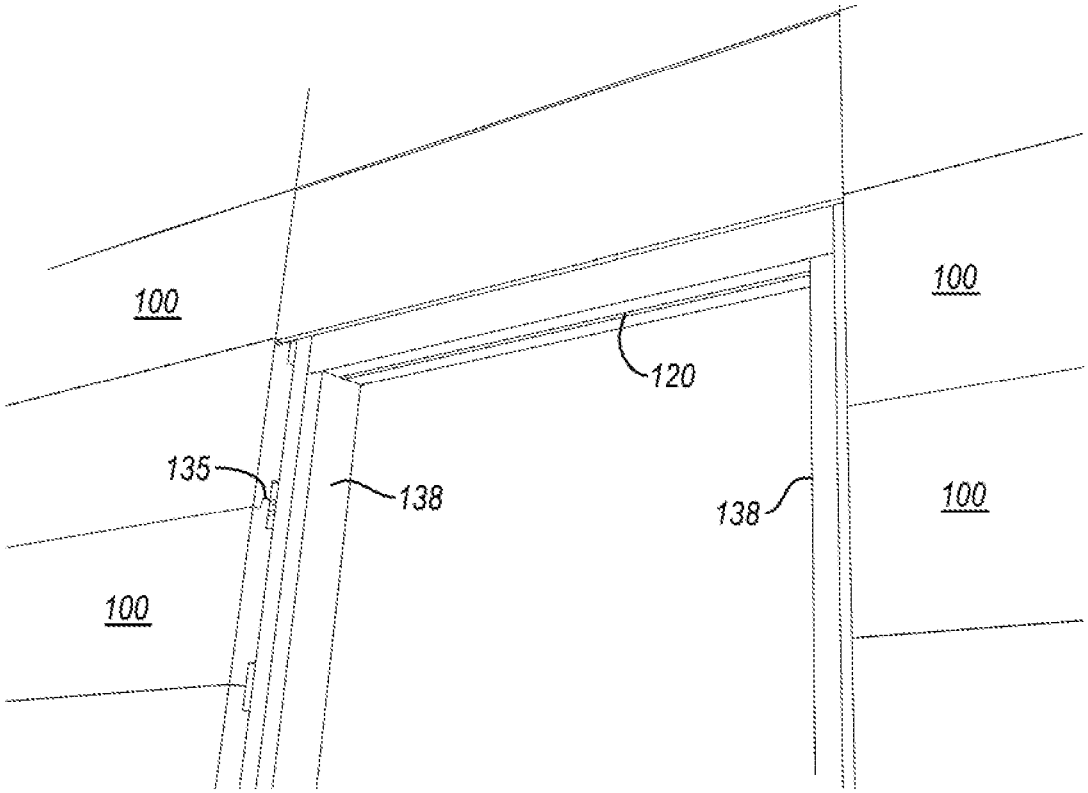
FIG. 10 shows how an opening, e.g., for a door or window, may be provided for in the post and beam construction systems including the modular panels of the present invention.

FIG. 10 illustrates how a door (or window) opening may be provided in any given wall, e.g., by placing vertical beams 138 at the ends of such an opening, which may be spanned by a conventional header 120. While the panels may be provided in lengths of 4 feet or any other desired length, they are easily cut, e.g., using a conventional circular saw (e.g., with a deep blade). They can easily be cut before insertion of any spline flanges and/or I-beams (in which case one is simply cutting through foam), or after such splines are inserted (in which case one is simply cutting through foam and typically OSB). Where desired, specialty header panels could be provided, e.g., including a header slot formed into panels 100, e.g., as disclosed in Applicant's U.S. Pat. No. 10,450,736, herein incorporated by reference in its entirety. Any of the concepts disclosed therein may be adapted for use with the present wall panels.

While shown with straight planar walls, it will be appreciated that curved walls are also possible, e.g., by providing closely spaced (e.g., 6 inches or less, 4 inches or less, 3 inches or less, or 2 inches or less, such as 1 inch spacing) pre-cut slits into at least one face of the panel that is to be used in forming a curved wall. Such slits would allow the panel to be flexed, creating a curved face.

A strap or any other desired typical connector may be used to attach any of the vertical posts 138 to a foundation, as will be appreciated by those of skill in the art, in light of the present disclosure.

While electrical raceways 136 may provide a simple way to make electrical runs, other methods for wiring a structure using the present panel, post and beam constructions are also possible. For example, because the exterior of the wall prior to sheathing is formed from a material such as EPS foam that is easily worked, a portable hot wire cutting tool may be used to quickly cut traces or raceways through the foam face, in any configuration desired, for receipt of electrical wiring. Furthermore, current code allows such wiring to not need any conduit, where there is 1.5 inches or more between the exterior of any eventually applied sheathing, and the location of the wiring. The 1-2 inch foam thickness before reaching any of the channels (i.e., spline), coupled with a typical ½ inch or ⅝ inch drywall sheathing allows the wiring to simply be pressed into grooves cut into the foam face during wiring of the building, without the need for any conduit for housing such wiring.

Where the wiring crosses over a spline, a spiked or other metal plate may simply be pressed over the wiring, over the spline, to prevent a fastener from penetrating the wiring, when attempting to fasten into the spline. Such forming of a raceway in the face of the panels can be quickly and easily accomplished after the panels have been raised into the desired wall structures, during wiring of the building. A portable hot wire groove cutting tool can be used for such raceway formation. Such a tool is very quick (e.g., an 8 foot groove length may be formed in a matter of seconds, and the grooves may be freely run over the face of the panels, without regard to spline location, and without passage through any splines (as would be typical in traditional framing). For example, such a groove may simply be "drawn" from a switch or other location to where the power is to be delivered (e.g., a light, outlet, etc.) in a straight line, across the panel(s) face(s).

In an embodiment, either the interior, exterior, or both foam panel faces of walls of a building may be tiled over with cementitious panels, e.g., such as available from Applicant. Because of the presence of the splines within the channels of the wall system, screws or other fasteners may be used for such attachment. An adhesive may additionally or alternatively be used. Any suitable adhesive may be used to adhere such panels to the foam face. While epoxy or urethane adhesives may be suitable in theory, a polymer modified cement based adhesive may be preferred, as the urethane and epoxy adhesives have been found by the present inventor to be finicky, making it difficult if a user wishes to reposition a panel once it has initially been placed over the adhesive coated foam.

For example, the epoxy and urethane adhesives typically set very quickly, providing little time for the user to perform any needed repositioning or adjustment of a placed panel. Furthermore, because the bonding strength is so great, when attempting to reposition such a bonded panel, chunks of underlying foam may be pulled from the foam frame structure (floor, wall, ceiling, roof, or the like) when attempting debonding, which is of course problematic. A polymer modified cement based adhesive provides greater cure time, allowing some flexibility in positioning, and repositioning, before the bond between the panel and foam frame member becomes permanent and strong. That said, urethane and epoxy adhesives (e.g., foaming adhesives) may also be used, where desired. Methods and other characteristics for such tiling, information relative to adhesives, and the like is found within Applicant's Application Serial No. U.S. patent application Ser. No. 15/426,756 (18944.9), herein incorporated by reference in its entirety. Examples of Applicant's other building systems which may include various features that can be incorporated to some degree herein include U.S. patent application Ser. Nos. 13/866,569; 13/436,403; 62/722,591; 62/746,118; 16/549,901, and 16/653,579, each of which is incorporated herein by reference in its entirety.

The last four patent applications describe exterior applied sealants that may be used, as such, in the present invention.

All components and steps of the method and system can be handled without heavy equipment (e.g., cranes), with the possible exception of any very large, heavy reinforcing structural members that may be embedded in any of the foam modular panel members, positioned between such panels, or the like. In fact, the modular panels are so light as to be easily handled and positioned by a crew of women. For example, the panels (e.g., 2 feet×4 feet) may weigh less than 40 lbs, less than 30 lbs, less than 20 lbs, or less than 15 lbs. The splines may also be handled and positioned by a crew of women. For example, because strips of such OSB material are very light (e.g., less than 10, 5 or even 3 lbs), and/or because there is typically no need to use splines that are of a single piece of continuous material, such crew members could push scrap material (e.g., scrap OSB strips) into the channels, which scrap material could serve as the splines. As a result, a construction site using such methods may generate very little, if any waste, e.g., far less such waste than is generated when using traditional framing techniques. In addition, it will be apparent that when constructing a given building, far fewer 2×4s will be needed, as there are no conventional single "studs" present in the construction, but rather use of OSB or similar elongate strips of material, as the splines are used, in conjunction with vertical post members (which may be formed from pairs of 2×4s), but which are only spaced typically every 4 feet, requiring far fewer 2×4s than a typical frame construction in which 2×4 studs are spaced at 24 or 16 inches on center.

Figure 11:
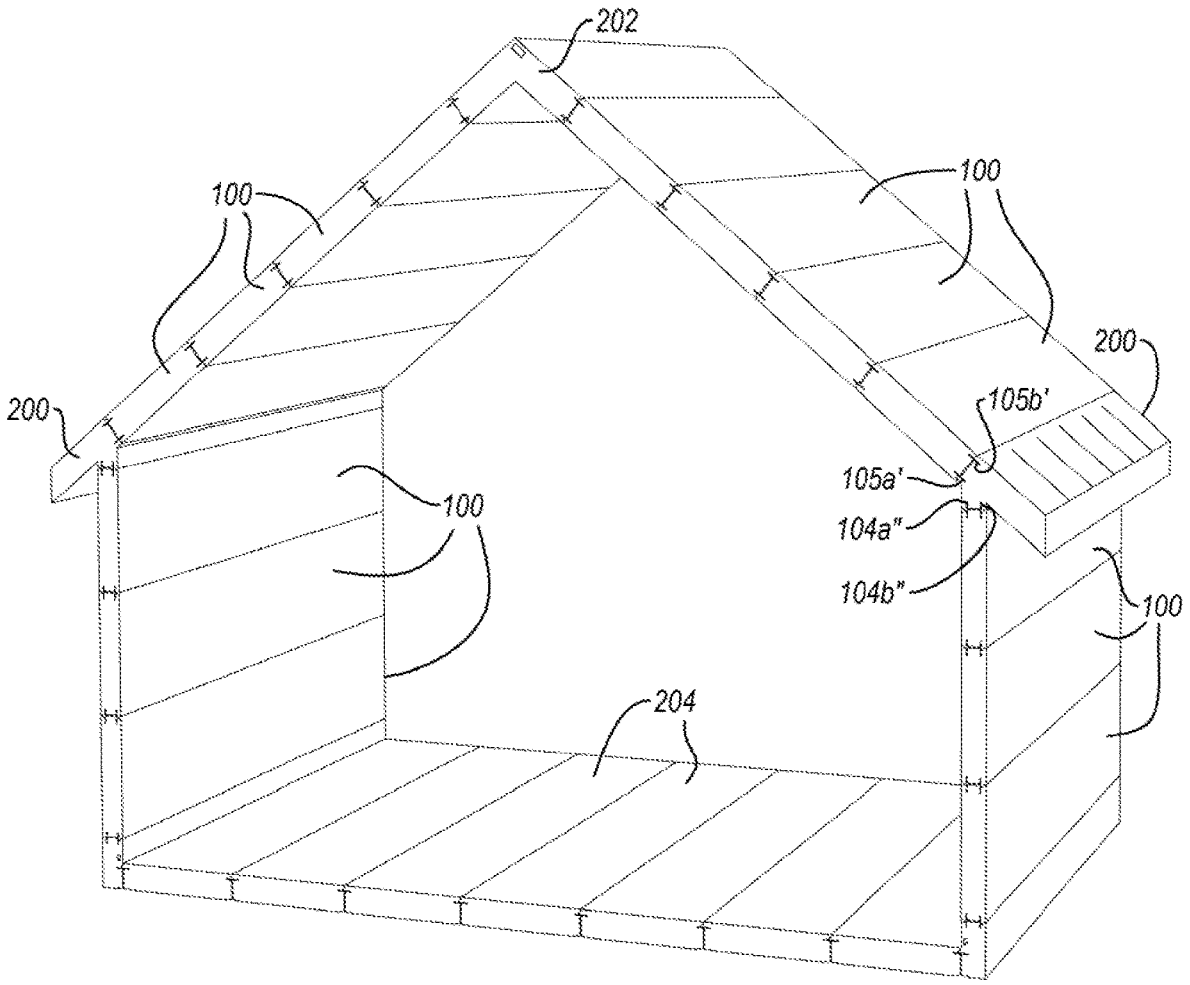
FIG. 11 shows how transition panels may be provided for connecting the panels used in a wall structure (e.g., such as that of FIG. 8) to the same standard panels used to form a roof structure.
Figure 12A:
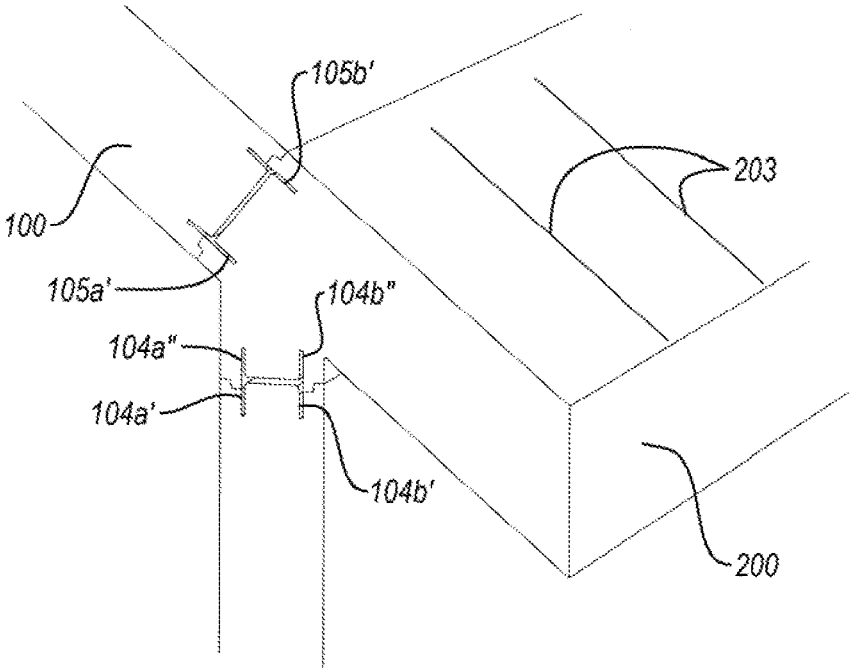
FIG. 12A shows a close up of the transition panel of FIG. 11, between the top most panel of the wall structure and the adjacent roof panel.

FIG. 11 shows an exemplary building construction that employs the panels 100 as described herein for construction of the walls, and which shows use of a transition panel 200 at the top of the wall structure, for providing a transition from such standard panels 100, to the same standard panels 100 used for the roof construction. Similar to panel 100, transition panel 200 is shown as including a pair of lower channels 104*a*" and 104*b*", allowing formation of an I-beam the same as with any of the standard wall panels 100, between the top most wall panel 100 and transition panel 200. Panel 200 is also shown as including an additional pair of channels 105*a*' and 105*b*', which are analogous to the top channels 104*a*' and 104*b*' of any of the standard wall panels, but which are oriented at an angle relative to bottom channels 104*a*", 104*b*", where the angle corresponds to the pitch of the roof being constructed. Channels 105*a*', 105*b*' thus line up with the bottom channels 104*a*" and 104*b*", respectively, of the standard panel 100 positioned as the first roof panel, adjacent transition panel 200, as shown. Transition panel 200 thus allows in-situ formation of an I-beam between the transition panel 200 and the top most wall panel 100, and another I-beam between the transition panel 200 and the adjacent roof panel 100. Transition panel 200 can include slots 203 for insertion of eave stiffening members, as shown. FIG. 12A shows a close up of the eave area of FIG. 11, better showing how the transition panel 200 integrates with the adjacent roof panel 100 and the adjacent top most wall panel 100.

FIG. 11 further shows a cap roof panel 202, configured to transition between standard roof panels 100, at the apex of such a pitched roof. Cap roof panel 202 also includes 2 pairs of edge channels, configured to be aligned with the top channels 104*a*' and 104*b*' of the two adjacent roof panels 100. The pairs of edge channels of the cap roof panel are angled relative to one another, e.g., at double the angle defined between the pairs of channels in transition panel 200, as dictated by the pitch of the roof. Such transition panels 200 and cap roof panels 202 may be custom provided to the building site, along with a desired number of standard panels (for walls and roof), as determined from the plan or blueprint of the building being constructed.

Figure 12B:
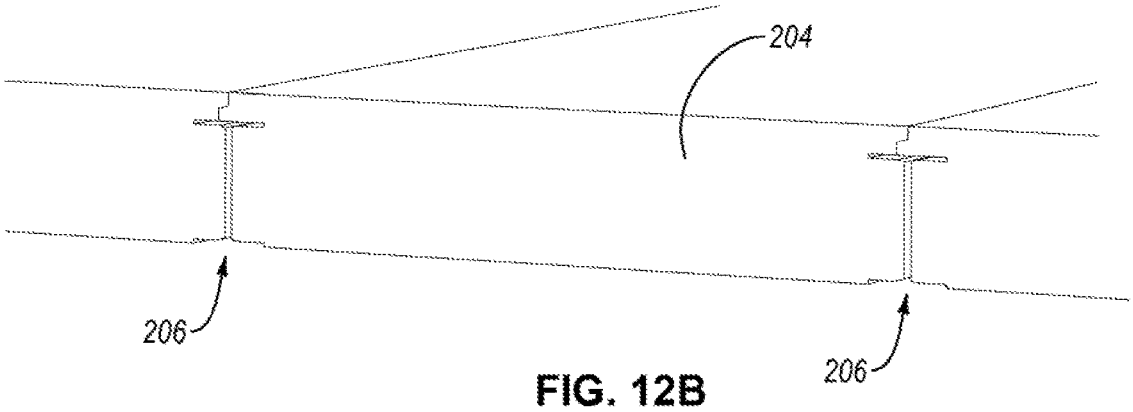
FIG. 12B shows a close up of the floor panel of FIG. 11.

FIGS. 11 and 12B further shows how panels similar to standard panels 100 may be used to form the floor. Such floor panels 204 may be similar to the standard wall and roof panels 100, except that they may only include one "top" channel, and one "bottom" channel adjacent the face of the panel that becomes the interior floor. Because the panels are rotated (laid on the ground instead of oriented vertically, as in a wall construction), what would be "top" and "bottom" channels are now simply both adjacent to the upper floor face of the panel, one to the right, and one to the left (rather than top and bottom).

The floor panel may not include channels adjacent the bottom face of the floor panels 204 (such panels may simply be positioned over a pea gravel base or the like). A notch 206 that is exposed on the bottom face of such floor panels 204 may be provided, e.g., to raise the floor panels up off such a gravel or other base, should such be desired. FIG. 12B shows a close up of such a floor panel, showing the notch 206.

FIGS. 13-28 illustrate a building system according to the present invention, in further detail, as a progressive construction of a simple, exemplary structure. It will be appreciated that more complex structures, in an essentially unlimited variety, may be constructed using the described building system. As shown, a plurality of standard panels 100 as described herein are used for the floor, the walls, and the roof. Specialized transition panels are provided to make the transition from wall to floor, (i.e., in a uniquely configured wall-to-floor transition panel), and from wall to roof (i.e., in a uniquely configured wall-to-roof transition panel). Where the roof is a pitched roof, a roof cap transition panel 202 may be provided, to make the transition from one standard panel to the next standard panel, both present in the roof (e.g., on different sides of the apex of a pitched roof).

The building system includes a frame that carries loads from the splines to the frame to the foundation. The frame can be designed to include any conceivable architectural shape, and can be engineered to handle appropriate external loads. The frame can act as a template in which splines and the insulating lightweight panels can be attached. This allows the splines and lightweight panels to remain standardized, with unique frames (formed from frame members) and unique transition panels defining the shape of the structure. This system makes it possible to construct walls, floors and roof of the system with precisely the same method.

Figure 13:
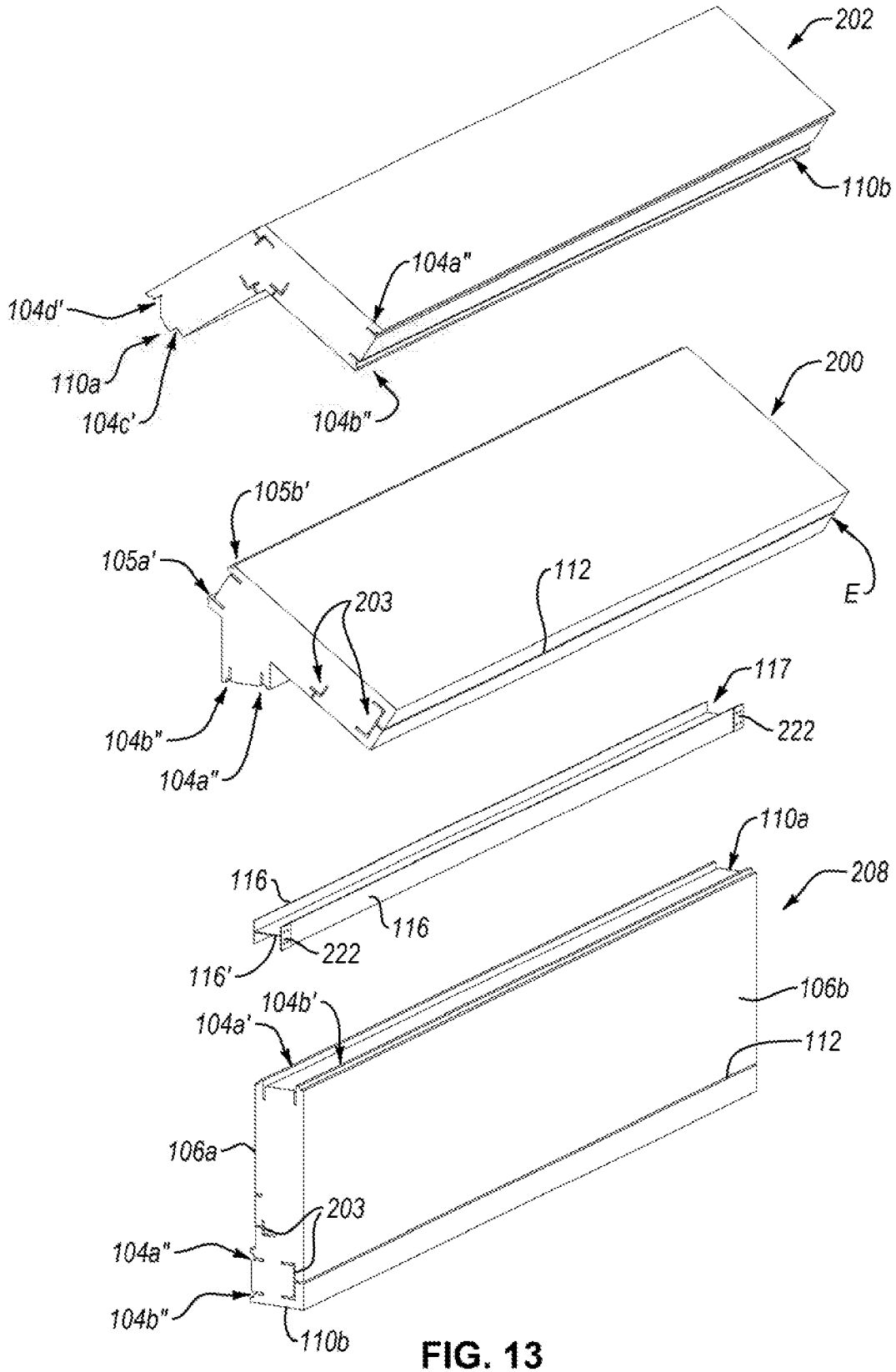
FIGS. 13-28 illustrate progressive construction according to an exemplary building system according to the present invention.

FIG. 13 shows various transition panels, including the uniquely shaped roof cap transition panel 202. As shown, panel 202 may include channels 104*a*" and 104*b*" identical to those of a standard panel 100 on one end, with the same channels 104*c*' and 104*d*' on the other end, but in which the top end 110*a* of the panel adjacent such channels 104*c*', 104*d*' is differently configured (e.g., includes cut-away portions) to better facilitate insertion of the roof cap transition panel 202 onto the apex of the roof, in a manner so as to mate with the adjacent standard panels 100, mating on either side of panel 202. The illustrated cut-away portions in top end 110*a*, adjacent channels 104*c*' and 104*d*' allows the "bottom end" 110*b* (configured the same as bottom end 110*b* of panel 100) of panel 202 to be pressed into the flanges 116 of I-beam 117, while the other end 110*a* is simply able to rotate downward towards the adjacent standard roof panel 100, so that the flanges 116 of the corresponding I-beam 117 rest in channels 104*c*' and 104*d*'. The cut-away top end 110*a* as shown in panel 202 allows simplified assembly as compared to requiring longitudinal sliding of panel 202 relative to the I-beams 117 mated on either end (at ends 110*a* and 110*b*).

FIG. 13 also illustrates a wall-to-roof transition panel 200 similar to that shown in FIGS. 11-12A. For example, transition panel 200 includes a pair of lower channels 104*a*" and 104*b*", for mating with an I-beam the same as with any of the standard wall panels 100, between the top most wall panel 100 and transition panel 200. Panel 200 is also shown as including an additional pair of channels 105*a*' and 105*b*', which are analogous to the top channels 104*a*' and 104*b*' of any of the standard wall panels 100, but which are oriented at an angle (other than 180°) relative to bottom channels 104*a*", 104*b*", where the angle corresponds to the pitch of the roof being constructed. Channels 105*a*', 105*b*' thus line up with the bottom channels 104*a*" and 104*b*", respectively, of the standard panel 100 positioned as the first roof panel, adjacent transition panel 200, as described herein. Transition panel 200 thus facilitates placement of an I-beam between the transition panel 200 and the top most wall panel 100, and another I-beam between the transition panel 200 and the adjacent roof panel 100 (through channels 104*a*", 104*b*" and channels 105*a*', 105*b*', respectively).

Transition panel 200 is also shown as including various shaped slots 203 for insertion of eave stiffening members, or to provide attachment points for facia, etc. The illustrated configuration includes a C-shaped slot 203 running horizontally, parallel to the free eave end E of the transition panel 200. As shown, a pre-cut slot 112 may be provided in eave end E, e.g., centered on C-shaped slot 203. In the illustrated configuration, the open end of the C is oriented inward, away from eave end E, providing an attachment point into which facia or other covering structures can be screwed, nailed, or otherwise fastened into. Other shaped slots could be provided, for receiving other shaped spline members (e.g., I-beam shaped, H-beam shaped, L-shaped, etc.).

Transition panel 200 may be described as including 3 portions—a wall leg (terminating in channels 104*a*", 104*b*") that mates with the adjacent top-most wall panel of the wall being constructed; a roof leg (terminating in channels 105*a*', 105*b*') that mates with the adjacent first roof panel of the pitched roof being constructed; and an eave portion, e.g., coplanar with the roof portion, but extending oppositely, away from channels 105*a*', 105*b*' and the roof portion, so as to form an eave of a desired configuration. It will be apparent that the length of the wall leg and the length of the roof leg can be independently specifically selected as needed, to accommodate a desired wall height (that is not an even multiple of the height of the standard panel 100), as well as to accommodate a desired roof plane length (that is not an even multiple of the width of the standard panel 100 used on the roof). Adjustments in roof plane length can also be made by adjusting the lengths of the two ends of the roof cap transition panel 202.

FIG. 13 further shows an exemplary wall-to-floor transition panel 208. Transition panel 208 is shown as similar to the standard wall and roof panels 100, including the top channels 104*a*' and 104*b*', with the top end of panel 208 being identically configured to any of the standard panels 100. Such top channels 104*a*' and 104*b*' receive flanges 116 of I-beam 117, connecting the transition panel 208 to the bottom most standard panel 100 of the wall structure. In order for transition panel 208 to connect in the same manner (through I-beams 117) to an adjacent standard panel 100 that makes up the floor, a pair of channels are provided in the inside face, near the bottom of transition panel 208, with otherwise identical characteristics to any of the other bottom channels 104*a*" and 104*b*", except that these channels are in the face 106*a* of panel 208 rather than in bottom end 110*b*. As shown, one or more additional slots 203 may additionally be provided, e.g., for providing attachment points, similar to slots 203 shown in wall-to-roof transition panel 200. For example, a C-shaped spline could be inserted into the C-shaped slot 203, while an L-shaped spline could be inserted (e.g., either or both horizontally) into the illustrated C and L-shaped slots. Of course other shaped slots could also be provided, as desired, to accommodate differently shaped splines in such slots.

Figure 14:
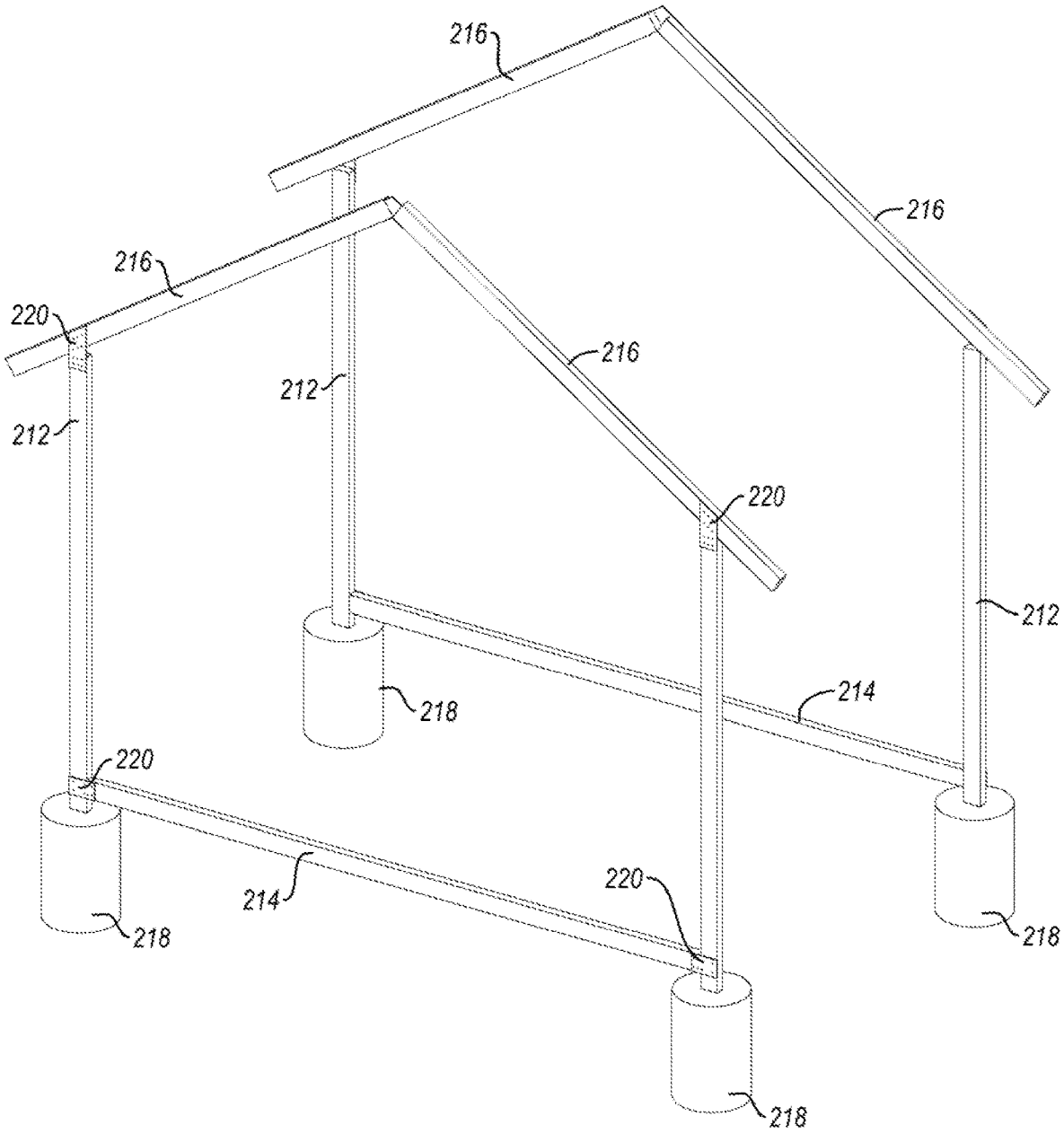

FIGS. 14-28 illustrate progressive steps according to which an exemplary building may be constructed, using the presently described building systems. For example, FIG. 14 shows assembly of an exemplary frame formed from exemplary vertical post frame members 212, horizontal beam frame members 214, and angled truss frame members 216. Such individual members may be connected to one another through appropriate brackets 220, as shown. It will be appreciated that where the building to be constructed may not include a pitched roof, the illustrated truss members may instead simply run horizontally, defining where the roof structure will be. Such a frame, in conjunction with the fact that the panels are cut using a CNC precision device, acts as a jig, ensuring that the walls, floor, and roof structure will be nearly perfectly square and plumb, as desired. Such is advantageous over traditional stick frame construction methods, where walls, floors, and roof often deviate slightly from the desired square and plumb relationships. Such frame members 212-216 may be of any desired material (e.g., steel, other metal, wood lumber, etc.). Steel may be preferred, as wood lumber can be notorious for being warped, etc. The frame may actually bear any load applied to the building, such that the panels 100 used to construct the walls are not necessarily load bearing (but merely fill the opening in).

As shown, the structure can be supported on a plurality of pier footings 218. Such a configuration as described does not require the use of any continuous footings, or the use of a typical concrete or similar slab. The present configurations may advantageously be void of such features, which otherwise increase costs, and result in decreased comfort (e.g., the present configuration provides for an insulated, "soft" floor, as compared to a concrete slab, as will be apparent from the present description).

Figure 15:
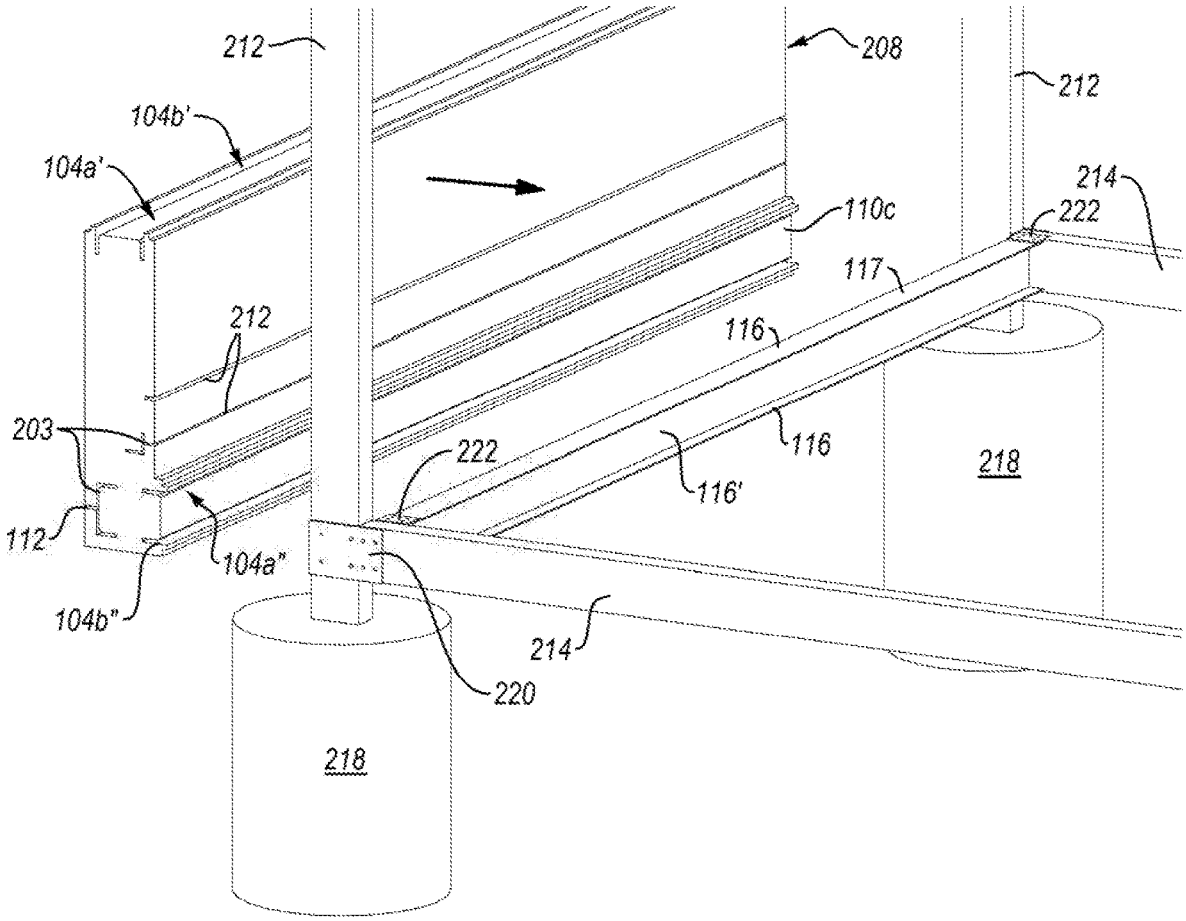

Turning to FIG. 15, one of the standard I-beams 117 may be attached between frame members (e.g., members 214), and wall-to-floor transition panel 208 positioned so that flanges 116 of I-beam 117 are received into channels 104*a*" and 104*b*". Web 116' of I-beam 117 rests against face 110*c* (analogous to bottom face 110*b* in a standard panel 100). It will be appreciated that the I-beams 117 could be provided prefabricated, as shown, or could be assembled in-situ, as described elsewhere herein. Such I-beams may be of aluminum or other suitable metal material, wood (e.g., OSB), plastic, or other suitable material.

While I-beam configurations are shown in particular, it will be appreciated that other geometry beams (e.g., C-beams, H-beams, L-beams, or other shapes, providing other moment of inertia characteristics) could alternatively be used for positioning in between any of the various modular panels, as splines.

Figure 16:
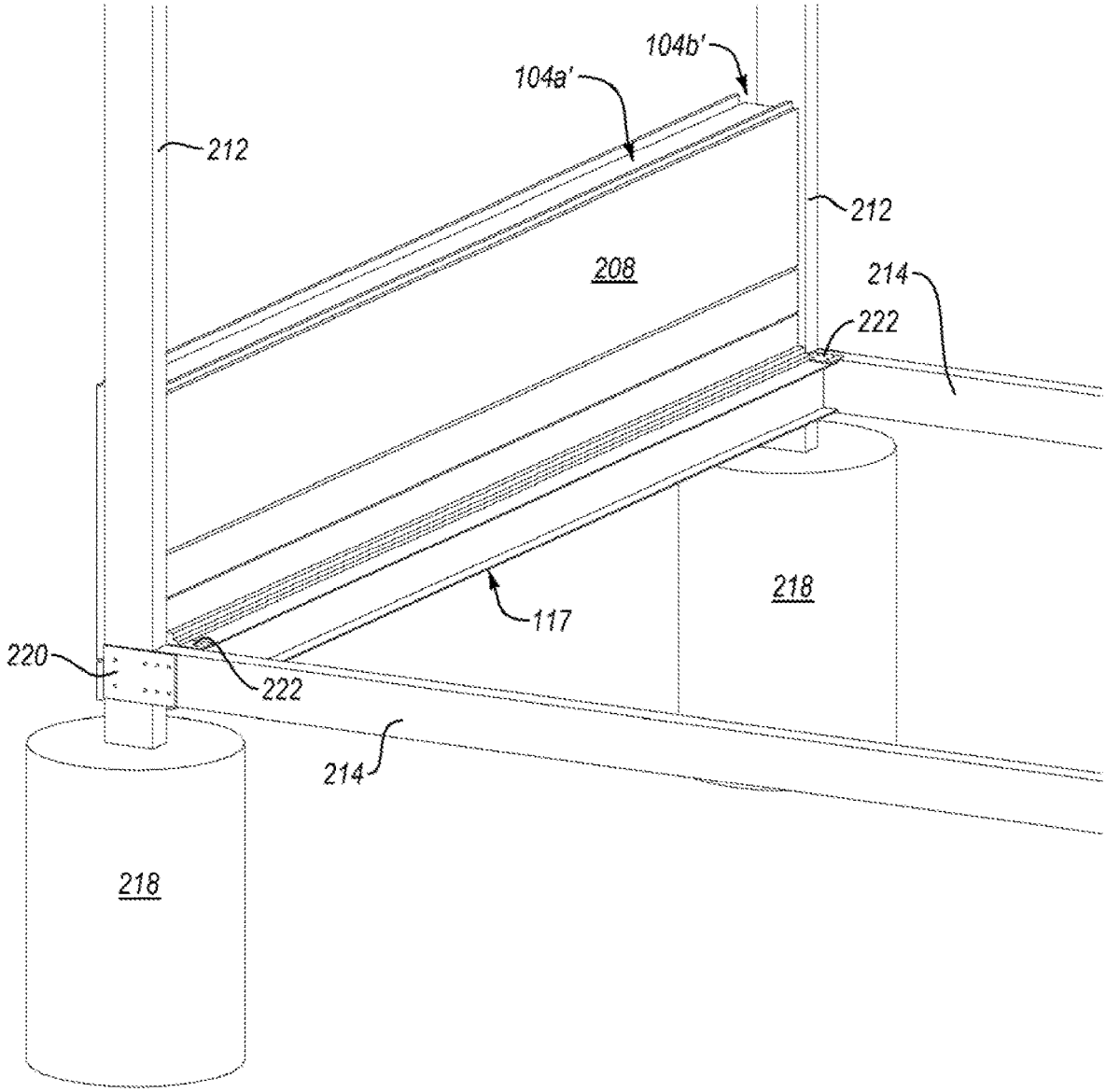

FIG. 15 further illustrates the use of connecting "ear" brackets 222. Such ear brackets can simply be fastened as shown, to appropriate frame members (e.g., as shown to frame members 214), securing I-beam 117 to members of the frame. Of course, panel 208 can be secured to I-beam 117 as described herein (e.g., use of an adhesive, or even just a friction fit between flanges 116 and channels 104*a*" and 104*b*"). FIG. 16 shows the same configuration as FIG. 15, once panel 208 has been fully inserted (i.e., flanges 116 into channels 104*a*" and 104*b*") relative to I-beam 117.

Figure 17:
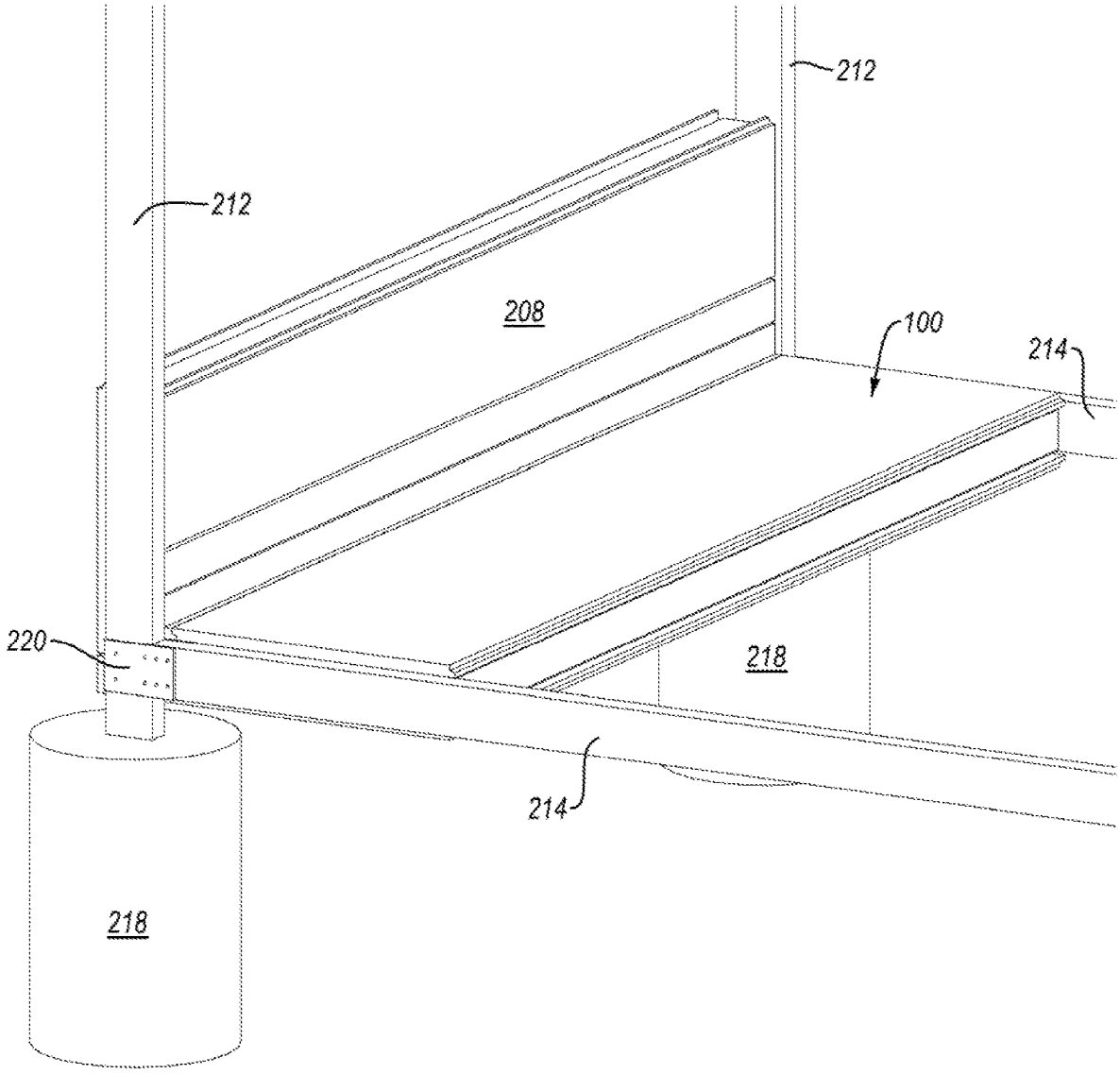
Figure 18:
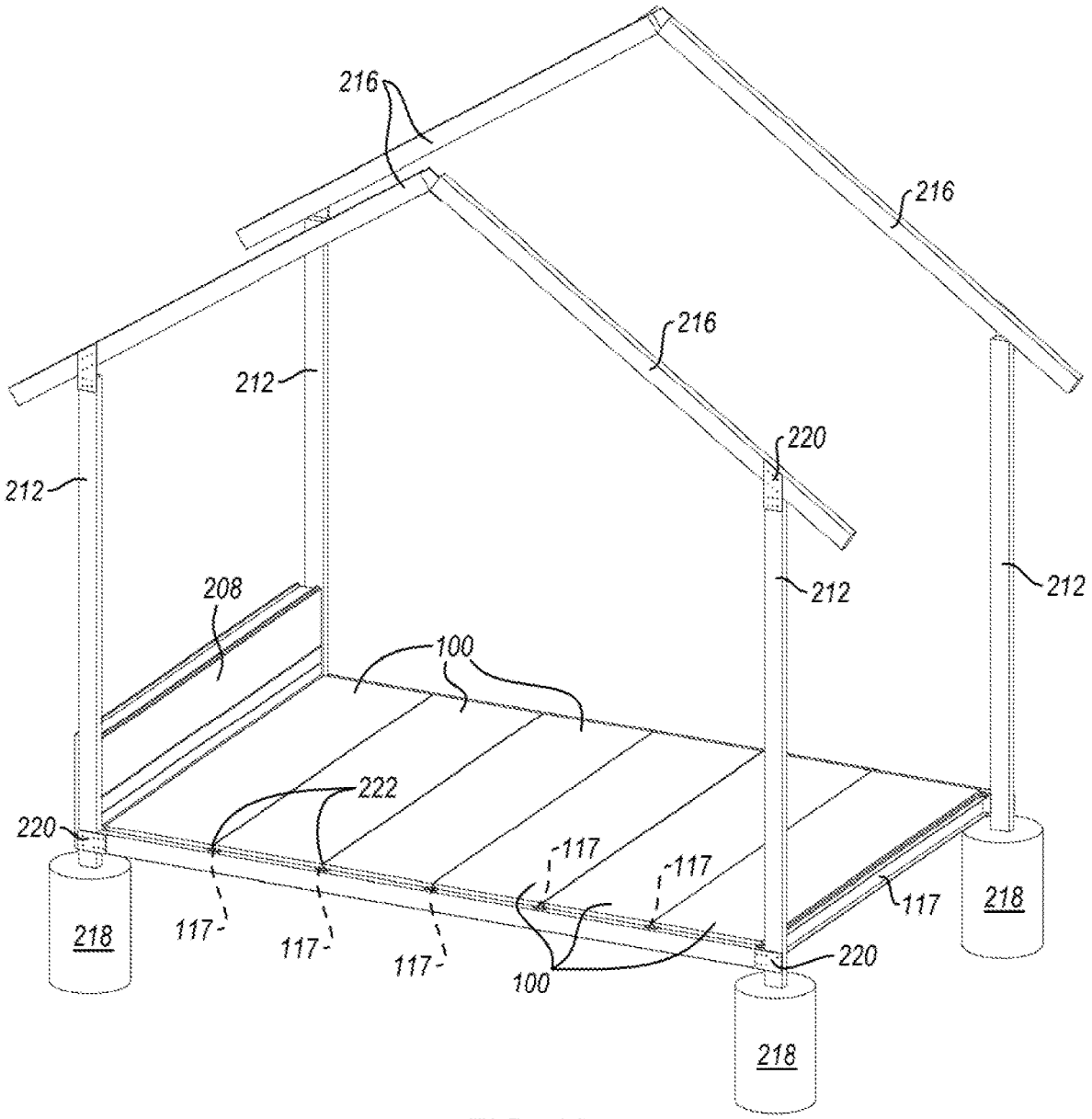
Figure 19:
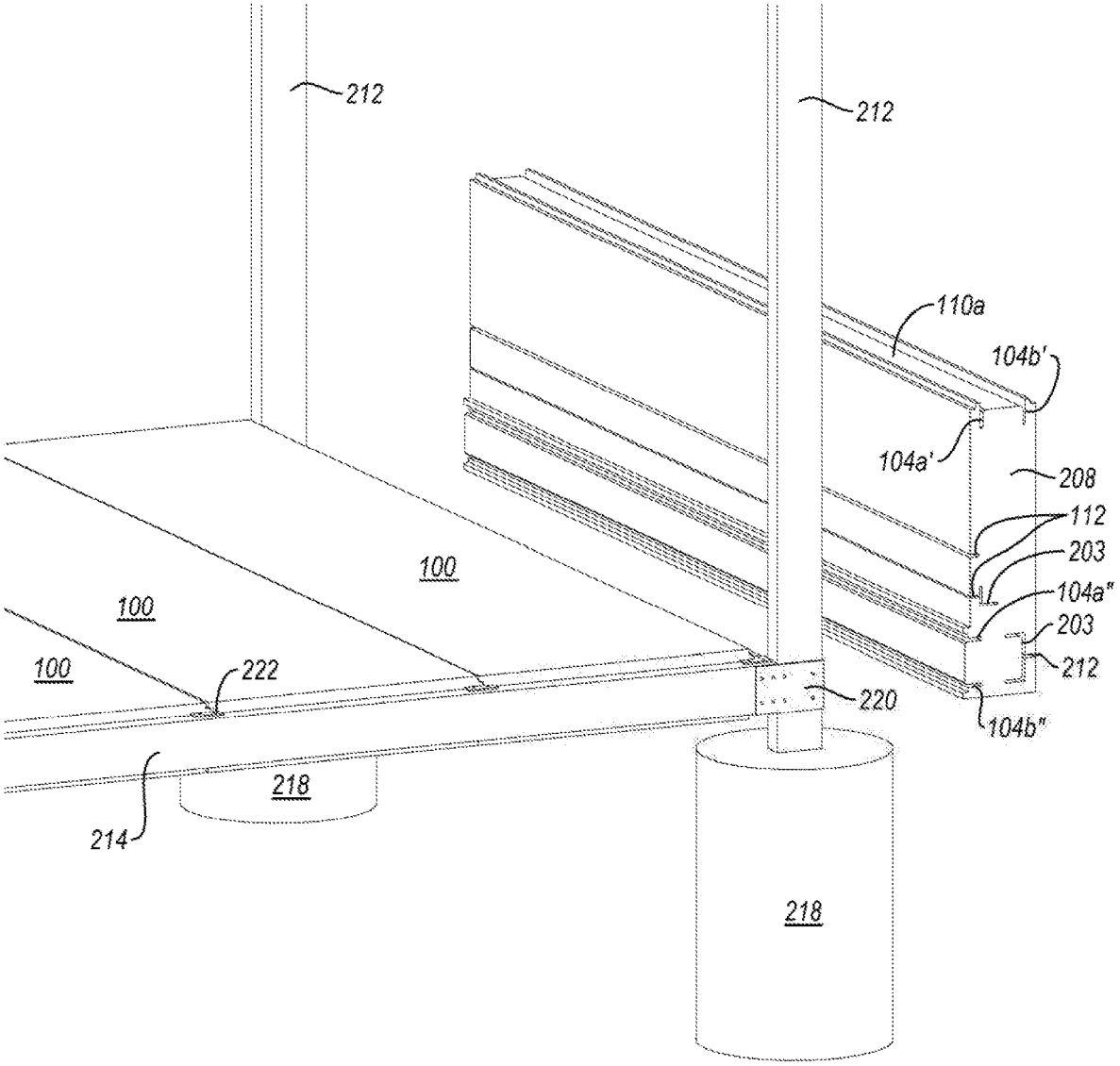
Figure 20:
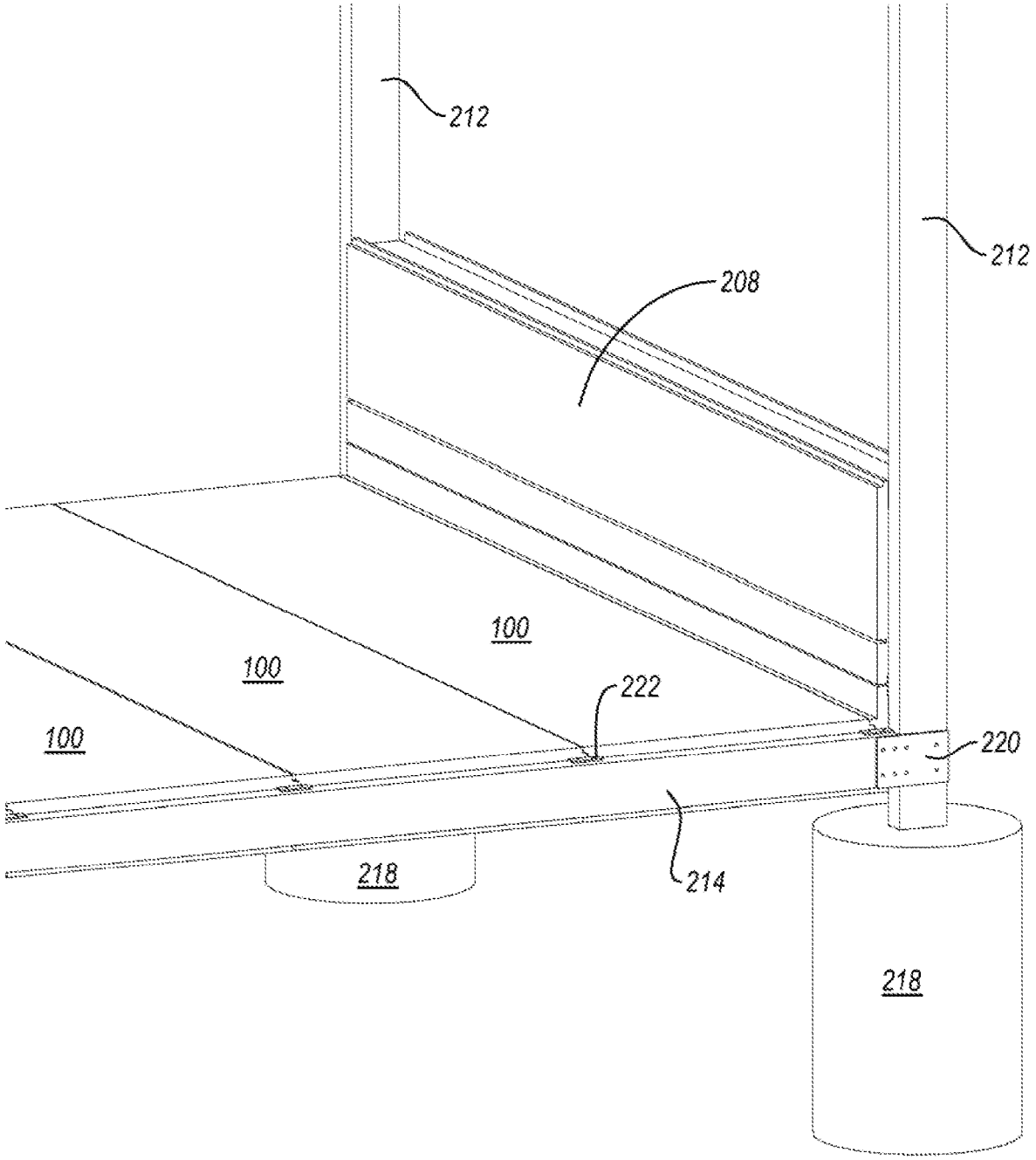

FIG. 17 illustrates the same configuration, but once a standard panel 100 has been positioned (e.g., slid) adjacent the I-beam 117 mated into the corresponding channels adjacent surface 110*c* of transition panel 208. As shown in FIG. 18, additional standard panels 100 can be positioned, to provide the floor structure of the building, with the standard I-beam or other splines 117 positioned in between each pair of adjacent panels. FIGS. 19-20 show attachment of another wall-to-floor transition panel 208, at the other end of the floor, where the opposite wall is to be constructed. Positioning and attachment of the panel 208 is similar to attachment of the panel 208 at the opposite end of the floor.

Because the panels 100 used on the floor are rotated (laid horizontally (e.g., "on the ground" instead of oriented vertically, as in a wall construction), what would be "top" and "bottom" channels are now simply adjacent to the top and bottom faces of the panel, on the right, and left sides. As shown, the floor may actually be a "floating floor", positioned above the ground in which the pier footings are positioned. While a pea gravel other base could be provided, such is not necessary, and may not be present.

Figure 21:
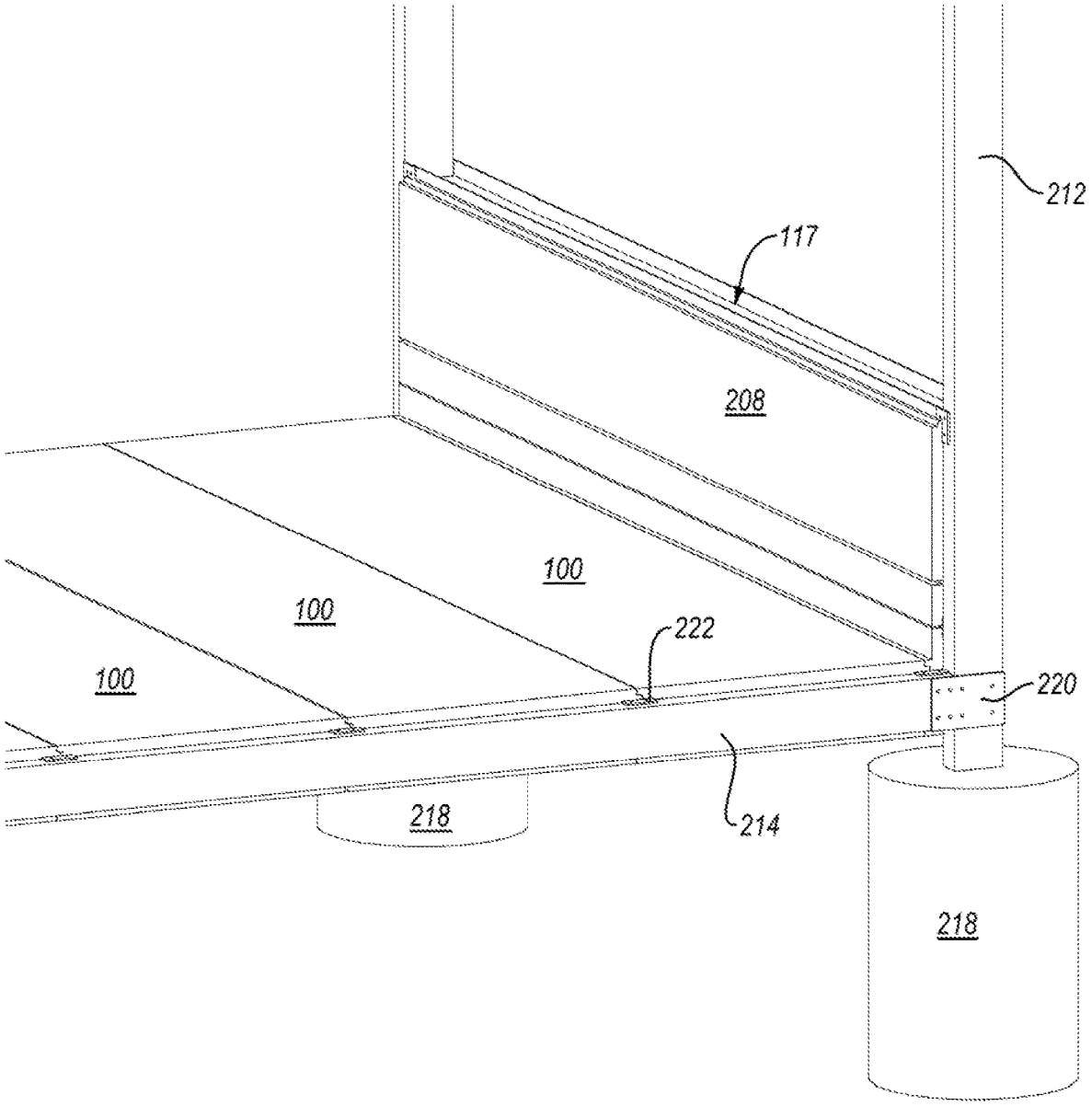

FIG. 21 shows the same configuration of FIG. 20, but with the addition of another of the standard I-beams, positioned in top channels 104*a*' and 104*b*', and adjacent surface 110*a*, in preparation for construction of the vertical wall that the transition panel 208 provides the transition to. As is apparent in the construction of the floor and walls, the I-beams 117 become embedded, and fully concealed within the constructed wall or floor or roof, without any exposure of such I-beams on the external major planar faces of the panels 100. Such lack of exposure is advantageous for preventing ghosting, and other benefits, as described herein.

Figure 22:
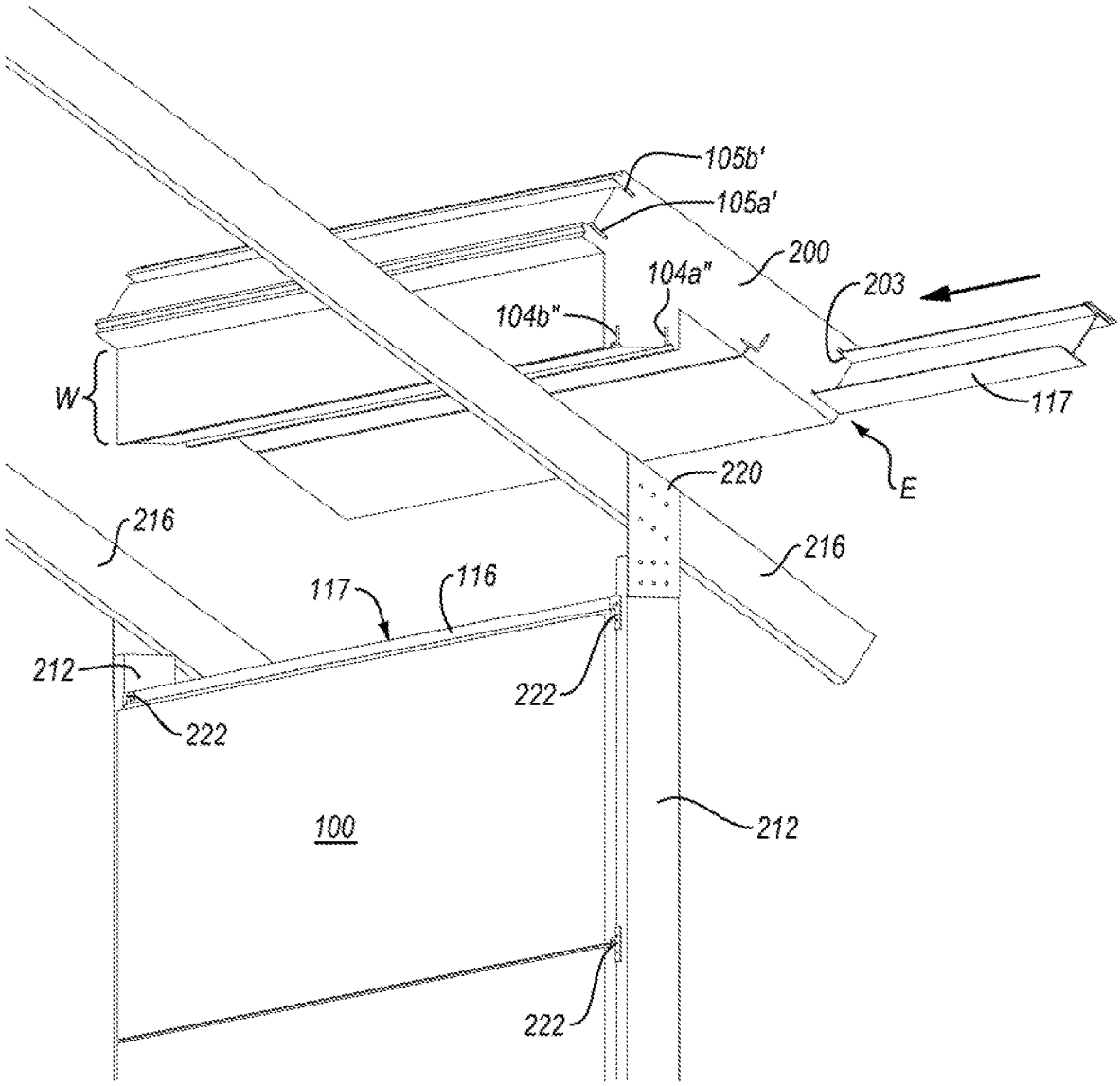
Figure 23:
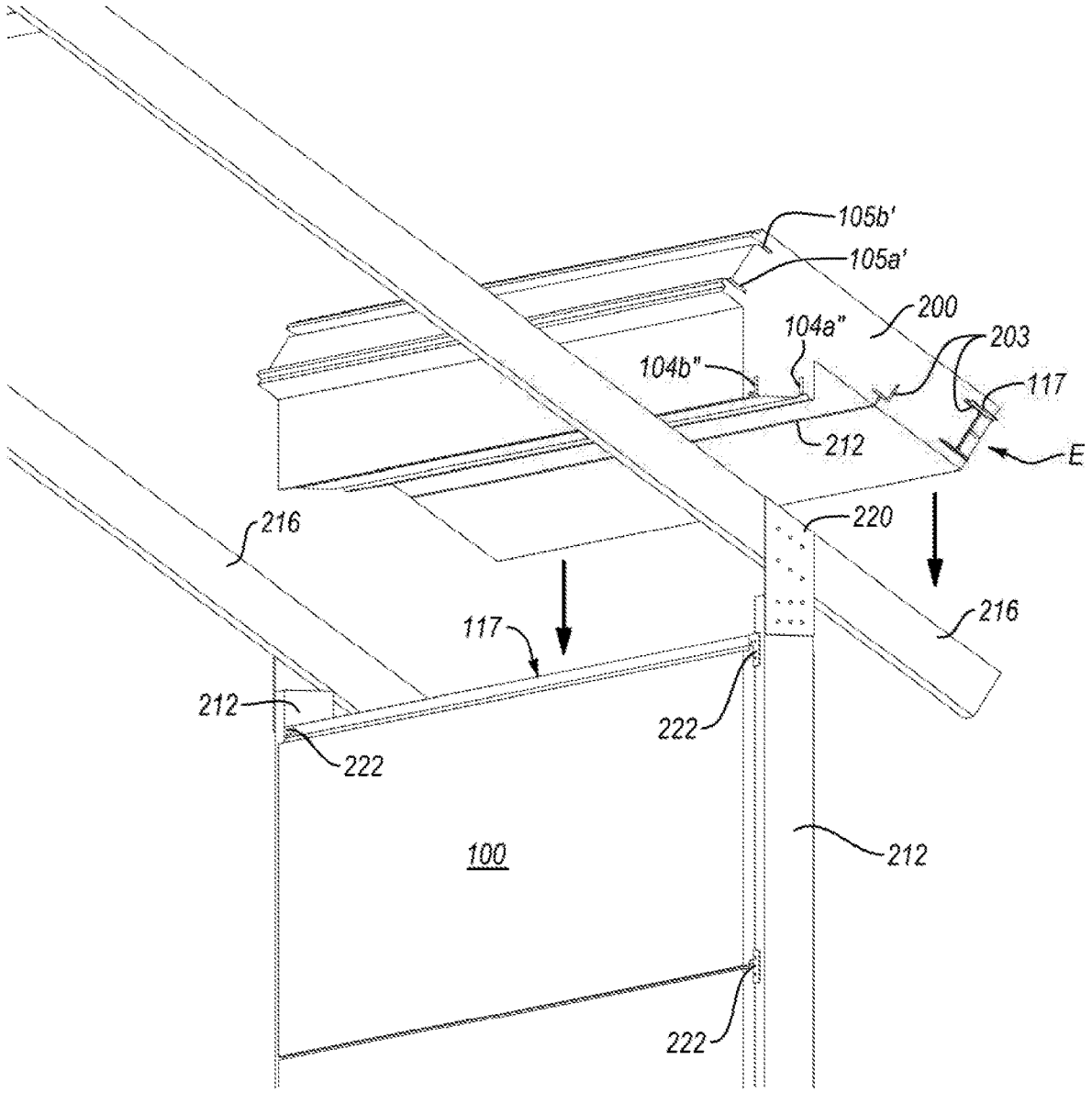
Figure 24:
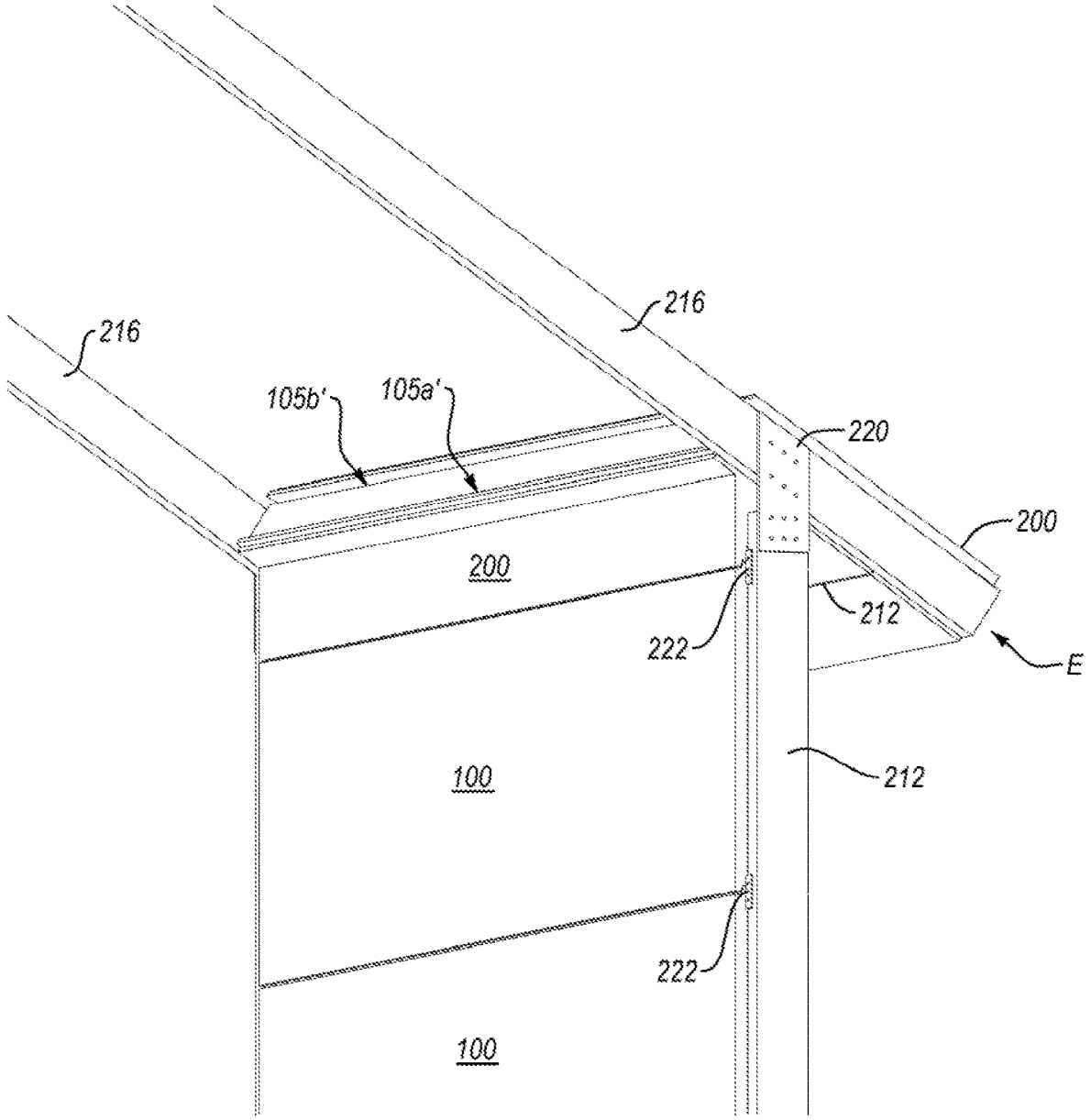

As shown in FIG. 22, once the desired number of wall panels 100 have been stacked, one upon another (with I-beams 117 in between each), the top of the wall structure can be capped with another transition panel, this time a wall-to-roof transition panel 200, already described in conjunction with FIG. 13. As is apparent from FIG. 22, an appropriate spline (e.g., I-beam 117) may be inserted into the slot 203 of transition panel 200, in the eave portion thereof. While FIG. 13 illustrates a C-shaped slot 203 adjacent the eave end E, FIG. 22 illustrates use of an alternative I-shaped slot, configured to receive one of the standard I-beam splines 117. It will be appreciated that various configurations are possible, to provide desired attachment points within eave end E of transition panel 200. With slot 203 filled with an appropriate stiffening member (e.g., I-beam 117 or other spline), panel 200 is maneuvered into position and mated into the I-beam 117 or other spline inserted into the corresponding slots of the top most panel 100 of the wall structure, as shown, in FIG. 23-24.

The height of any desired wall can be accommodated (even where the height does not correspond to an even multiple of the standard panel height, such as 2 feet), by adjusting the length of the vertical wall leg W (FIG. 22) of the transition panel 200. For example, for an 9 foot wall height, 4 panels each of 2 feet in height will provide 8 feet of the wall height, such that the length of the vertical wall leg W may be set at the needed 1 foot, to accommodate the desired height. It will be apparent that such configuration accommodates any desired wall height.

A similar adjustment to the length of the roof plane is similarly provided by the length that is selected for the roof leg (the leg that is adjacent to the wall leg W, which is angled therefrom, at an angle corresponding to the pitch of the roof being formed). In other words, accommodation of specific roof plane lengths are possible by adjusting the length of the roof leg of panel 200, (i.e., that leg including channels 105*a*' and 105*b*'). The length of this roof leg portion of the wall-to-roof transition panel 200 allows selection of an appropriate length to accommodate a desired roof length for the roof which it forms a top portion of.

It is also apparent that the transition panel also dictates the shape and length of the eave associated with the roof. Such integration of the eave into the transition panel 200 is advantageous, as it eliminates the need for construction of separate eave members (which is time consuming, and tedious, as those in the construction trade will appreciate). For example, the eave portion of the panel 200 is shown as being coplanar with the roof leg, extending oppositely therefrom (i.e., on the other side from the roof leg, relative to the wall leg W that separates the eave portion from the roof leg of the transition panel 200).

Figure 25:
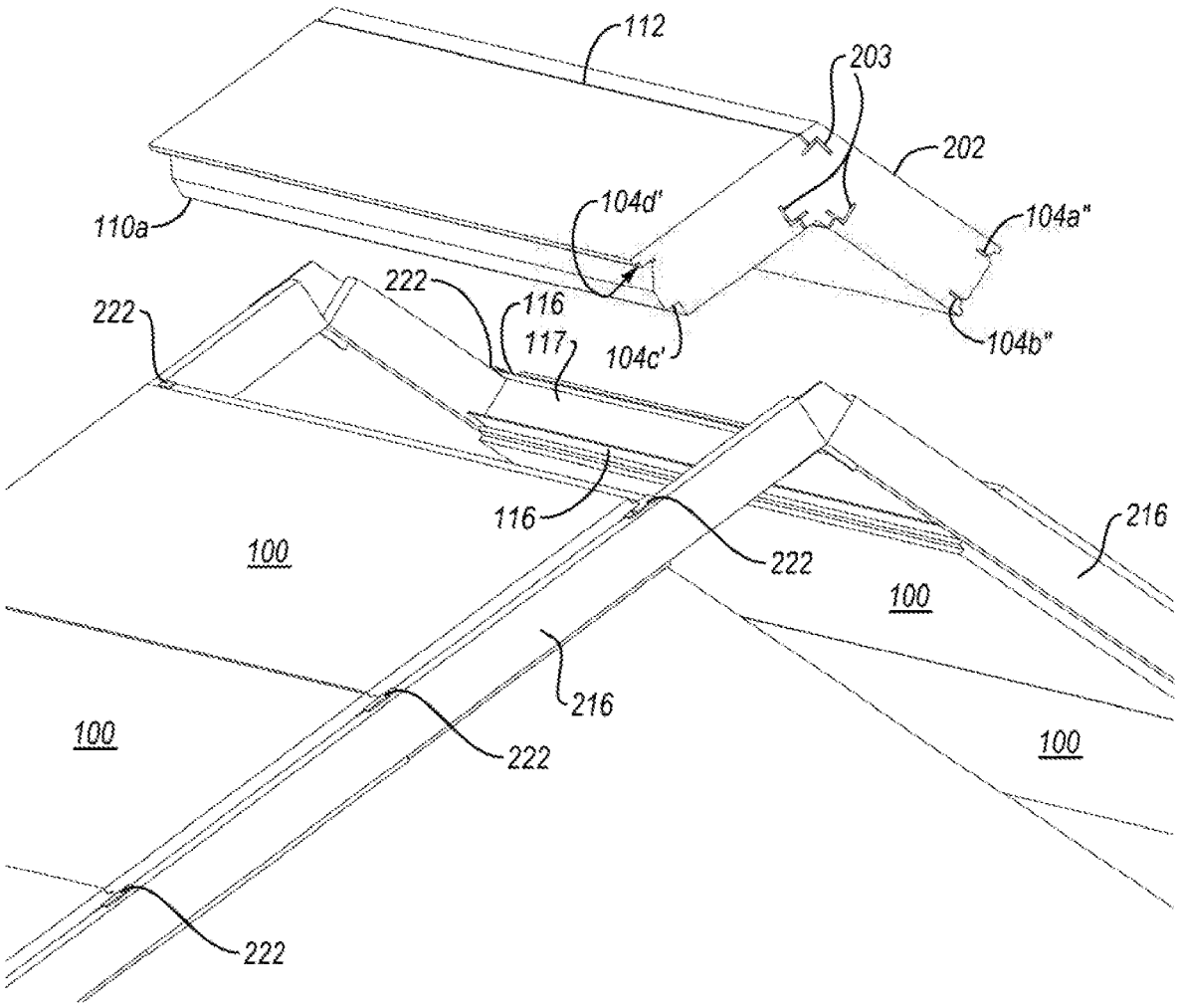

As shown in FIG. 25, with the wall-to-roof transition panel 200 in place, the roof can be constructed by using the same standard panels 100 that were used on the walls and floor, by simply positioning each panel between the truss members 216 of the building frame, inserting an I-beam spline into the channels 104*a*', 104*b*' of one panel, and 104*a*", 104*b*" of the adjacent panel. Of course, the flanges 116 of the I-beam positioned between the first standard roof panel 100 and the transition panel 200 is accommodated in the same manner, with one side of the flanges 116 of I-beam 117 received into channels 105*a*' and 105*b*' of transition panel 200, and the other side of the flanges 116 of the same I-beam 117 received into channels 104*a*" and 104*b*" of the standard panel 100 of the roof. As shown in FIG. 25, both sides of such a pitched roof are formed in this manner until reaching the area of the apex of such a pitched roof.

Figure 26:
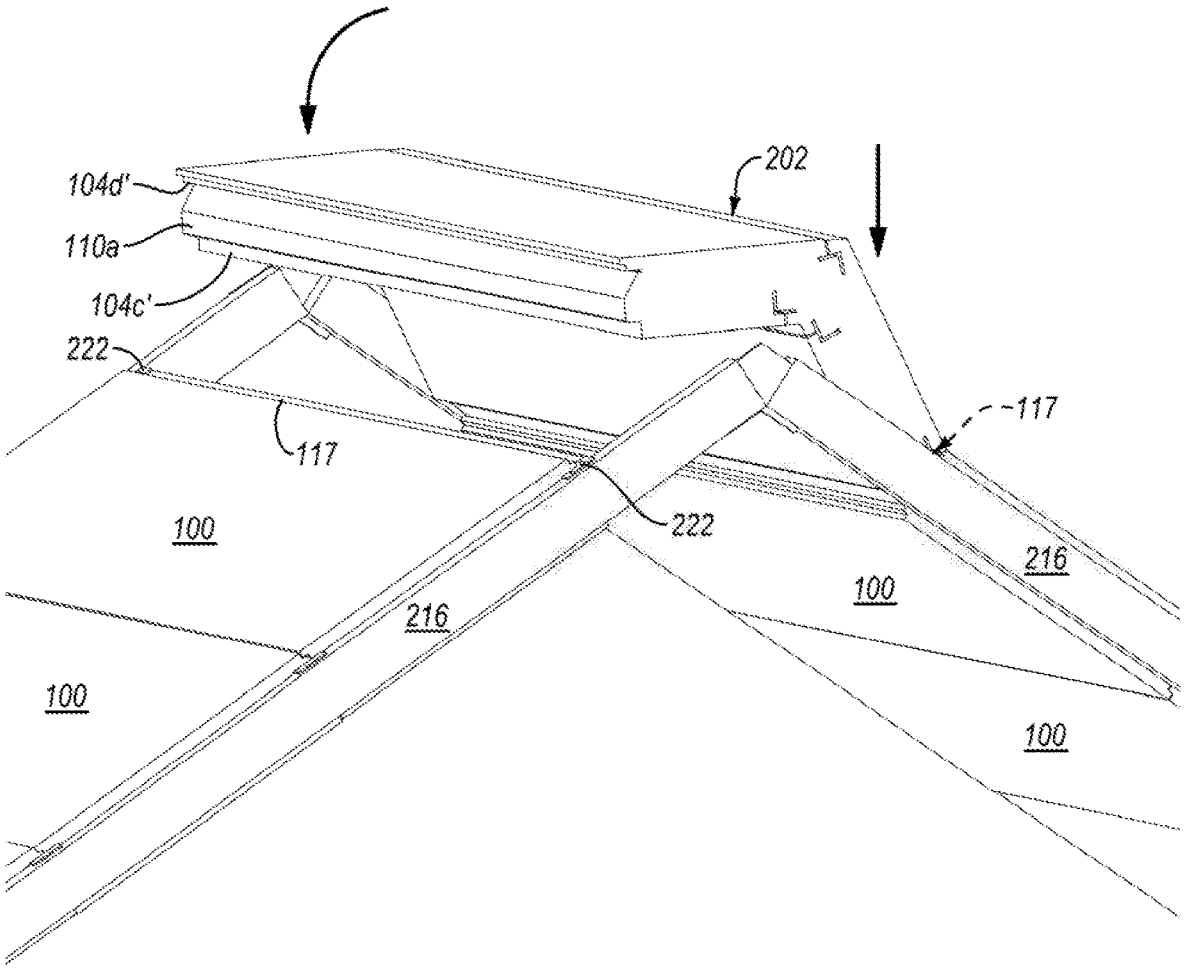
Figure 27:
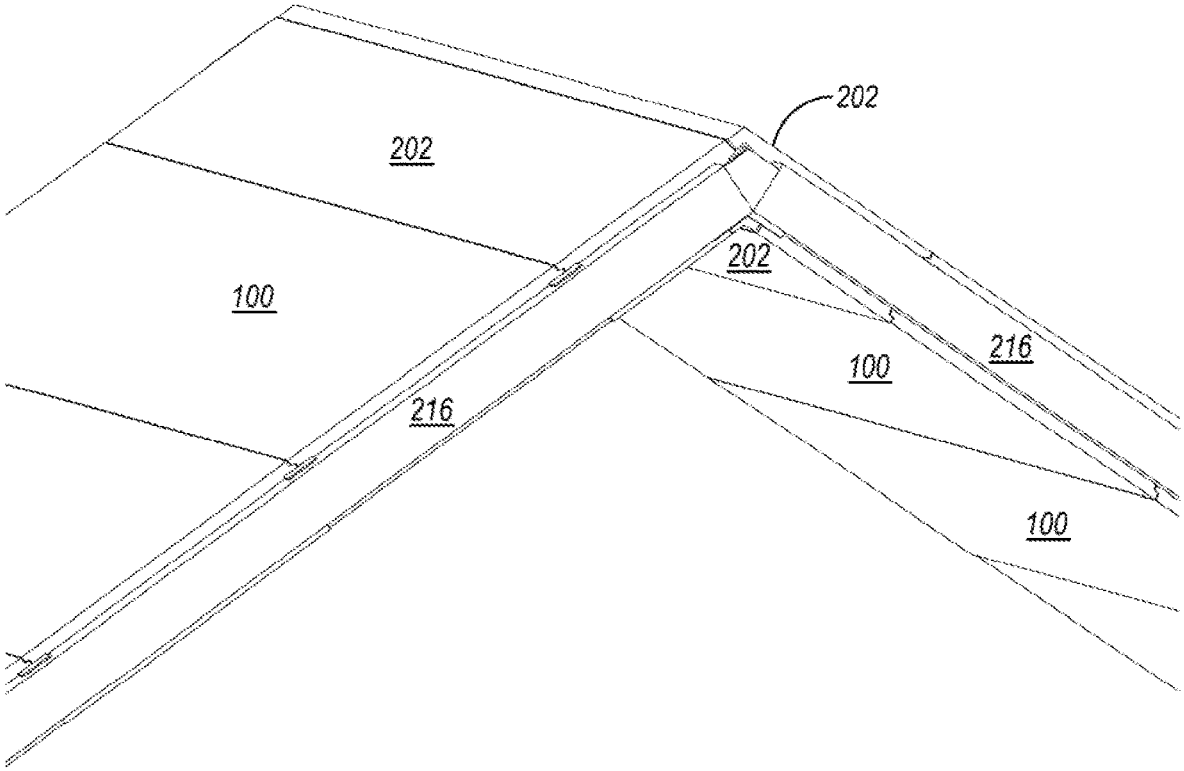

As shown in FIGS. 25-27, the roof cap transition panel 202 is used to complete the apex portion of the roof structure. As shown in FIG. 26, once the more standard channels 104*a*" and 104*b*" are engaged with their corresponding I-beam 117, the roof cap transition panel 202 may be rotated downward, and because of the cut-away portion at surface 110*a* of transition panel 202, its rotation is unimpeded as it rotates into proper engagement with the I-beam 117 on the other end, for reception into channels 110*c*' and 110*d*'.

Figure 28:
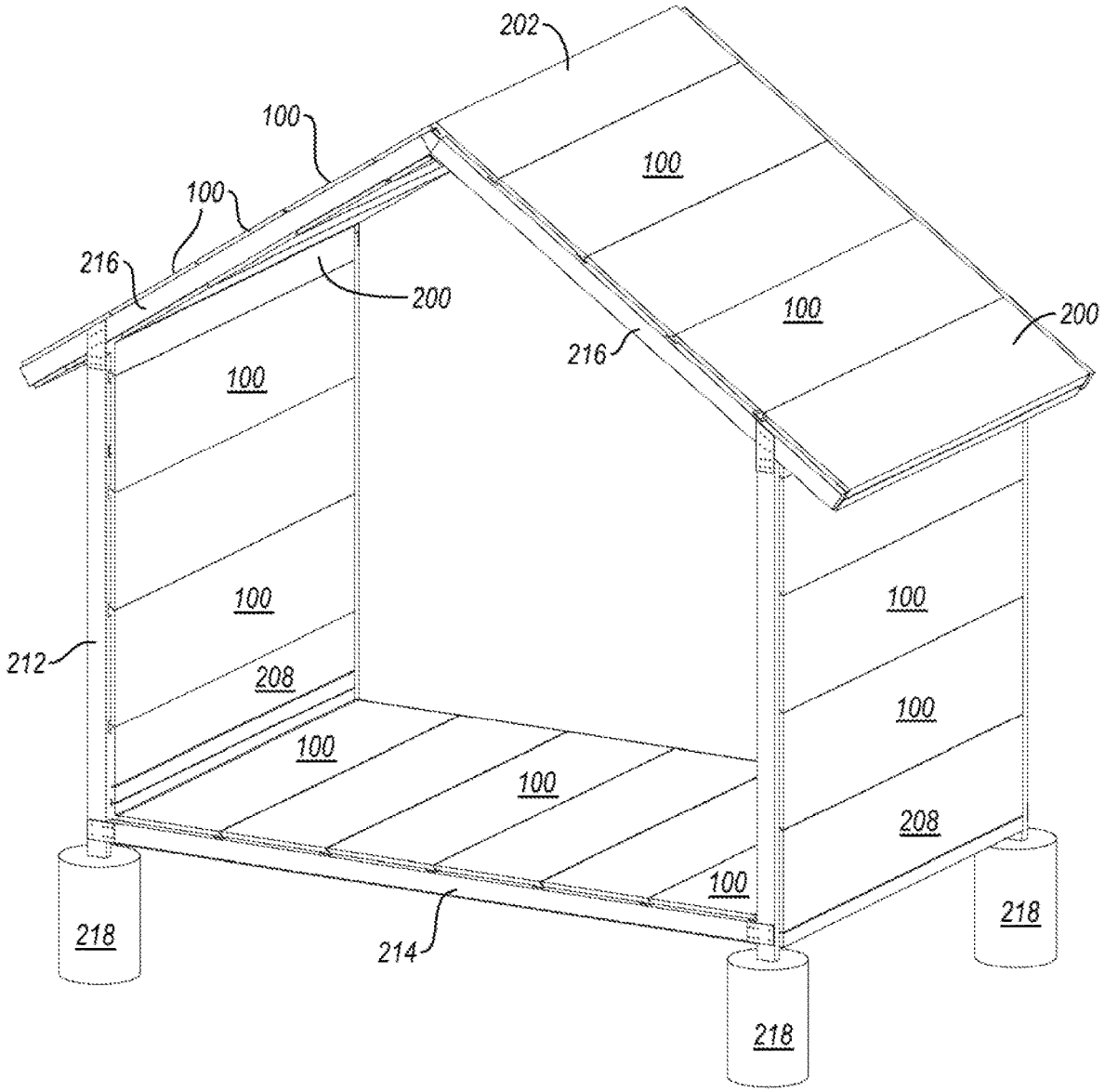

FIG. 28 shows the exemplary structure complete, with floor, walls, and roof. The other walls at either end are shown open to better illustrate the other structures, although it will be appreciated that these walls may be filled in with standard wall panels using the same building system and techniques as described herein.

By way of example, the standard (and other panels) may each be provided in a standard dimension, such as 2 feet in height, by 8 feet in length. Such exemplary panels are lightweight, for example, weighing about 6 lbs for the standard panels 100 shown. If pre-fabricated I-beams 117 are used, e.g., made of aluminum, such similarly only weigh about 7 lbs. The system is thus easily employed by those of limited strength, and without any skilled training.

While the Figures illustrate construction of simple exemplary walls and buildings to illustrate concepts of the present construction methods and systems, it will be appreciated that the methods and systems may be used to construct a nearly endless variety of buildings.

It will also be appreciated that the present claimed invention may be embodied in other specific forms without departing from its spirit or essential characteristics. The described embodiments are to be considered in all respects only as illustrative, not restrictive. The scope of the invention is, therefore, indicated by the appended claims rather than by the foregoing description. All changes that come within the meaning and range of equivalency of the claims are to be embraced within their scope. Additionally, as used in this specification and the appended claims, the singular forms "a," "an" and "the" include plural referents unless the context clearly dictates otherwise.

The invention claimed is:

1. A building system comprising:

a plurality of standard panels, the standard panels forming walls, a roof, and a floor of a building;

a wall-to-roof transition panel positioned between one of the standard panels of the roof, and one of the standard panels of one of the walls;

wherein the transition panel dictates a roof pitch and shape and length of an eave associated with the roof;

wherein the building system further comprises an exterior frame comprising vertical posts to which the standard panels and transition panels are attached;

wherein the standard panels are attached to members of the exterior frame by ear brackets attached to elongate splines extending horizontally through channels formed in each of the standard panels.

2. A building system as recited in claim 1, wherein the wall-to-roof transition panel includes a roof leg and a vertical wall leg, the roof leg being at an angle relative to the vertical wall leg that corresponds to the roof pitch of the roof.

3. A building system as recited in claim 2, wherein a height of the vertical wall leg can be selected to accommodate a desired wall height for the wall which it forms a top portion of.

4. A building system as recited in claim 1, wherein the standard panels of the walls are attached to the vertical posts, the exterior frame further comprising horizontal beams to which the standard panels of the floor are attached, the exterior frame further comprising truss members to which the standard panels of the roof are attached.

5. A building system as recited in claim 1, wherein the elongate splines extending horizontally through the channels comprise I-beams.

6. A building system as recited in claim 1, wherein the elongate splines in the form of I-beams are provided extending horizontally between each of the standard panels.

7. A building system as recited in claim 1, wherein the elongate splines in the form of I-beams are provided extending horizontally between the wall-to-roof transition panel and the adjacent standard panel of the roof, and between the wall-to-roof transition panel and the adjacent standard panel of the wall.

8. A building system as recited in claim 1, wherein each standard panel and the wall-to-roof transition panel each comprises a pair of channels extending horizontally through a length of each panel, configured to receive a portion of a flange of an I-beam spline that is positioned between said panel and a corresponding adjacent panel.

9. A building system as recited in claim 1, wherein each standard panel comprises:

a lightweight body;

a plurality of channels extending horizontally through a length of the panel, each channel being configured to receive an elongate spline therein, wherein each elongate spline once received in the channel is at least partially disposed within the lightweight body, without the spline being exposed on an outside major planar face of the lightweight body, so that the elongate spline is restrained once received within the channel.

10. A building system as recited in claim 1, wherein the wall-to-roof transition panel accommodates an increased height to the wall, by including a vertical length to a wall leg of the transition panel adjacent to the wall, that adds to the wall height.

11. A building system as recited in claim 1, wherein the wall-to-roof transition panel accommodates an increased length to the roof, by including a roof leg having a selected length that adds to the length of the roof.

12. A building system as recited in claim 1, wherein the wall-to-roof transition panel further includes a slot for insertion of an eave stiffening member.

13. A building system as recited in claim 12, wherein the slot for insertion of an eave stiffening member is a C-shaped, I-shaped, H-shaped, or L-shaped slot, running horizontally, parallel to a free eave end of the wall-to-roof transition panel.

14. A building system comprising:

a plurality of standard panels, the standard panels forming walls, a roof, and a floor of the building;

the building system further comprising at least one of (i) or (ii) below:

(i) a wall-to-roof transition panel positioned between one of the standard panels of the roof, and one of the standard panels of one of the walls, wherein the transition panel dictates a roof pitch associated with the roof;

(ii) a wall-to-floor transition panel positioned between one of the standard panels of the floor, and one of the standard panels of one of the walls;

wherein the building system further comprises an exterior frame comprising vertical posts to which the standard panels and wall-to roof or wall-to-floor transition panels are attached;

wherein the standard panels are attached to members of the exterior frame by ear brackets attached to elongate splines extending horizontally through channels formed in each of the standard panels.

15. A building system as recited in claim 14, wherein the building system comprises both the wall-to-roof transition panel of (i) and the wall-to-floor transition panel of (ii).

16. A building system as recited in claim 14, wherein the building system comprises the wall-to roof transition panel, the wall-to-roof transition panel including an angled roof leg and a vertical wall leg, the angled roof leg being at an angle relative to the vertical wall leg that corresponds to the roof pitch of the roof.

17. A building system as recited in claim 16, wherein a height of the vertical wall leg can be selected to accommodate a desired wall height for the wall which it forms a top portion of.

18. A building system as recited in claim 16, wherein a length of the roof leg can be selected to accommodate a desired roof length for the roof which it forms a portion of.

* * * * *